US010648167B2

(12) United States Patent
Satchell et al.

(10) Patent No.: US 10,648,167 B2
(45) Date of Patent: May 12, 2020

(54) SLOTTED JOIST SEAT STRUCTURE AND METHODS OF DESIGNING AND BUILDING THE STRUCTURE

(71) Applicant: NUCOR CORPORATION, Charlotte, NC (US)

(72) Inventors: Terence Lee Satchell, Gadsden, AL (US); Daniel Joseph Watkins, Fort Payne, AL (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 15/921,041

(22) Filed: Mar. 14, 2018

(65) Prior Publication Data

US 2019/0284793 A1 Sep. 19, 2019

(51) Int. Cl.
*E04B 1/24* (2006.01)
*E04B 5/10* (2006.01)

(52) U.S. Cl.
CPC ..... *E04B 1/2403* (2013.01); *E04B 5/10* (2013.01); *E04B 2001/2421* (2013.01); *E04B 2001/2427* (2013.01); *E04B 2001/2454* (2013.01); *E04B 2001/2457* (2013.01); *E04B 2001/2484* (2013.01); *E04B 2103/06* (2013.01)

(58) Field of Classification Search
CPC .. E04B 1/2403; E04B 5/10; E04B 2001/2454; E04B 2103/06; E04B 2001/2484; E04B 2001/2427; E04B 2001/2421; E04B 2001/2457
See application file for complete search history.

(56) References Cited

U.S. PATENT DOCUMENTS 5,720,571 A * 2/1998 Frobosilo ..... E04B 2/96 403/2
5,846,018 A * 12/1998 Frobosilo ..... E04B 2/96 403/403
5,876,006 A * 3/1999 Sharp ..... E04B 1/2403 248/297.21
8,096,084 B2 * 1/2012 Studebaker ..... E04B 1/003 52/250

(Continued)

FOREIGN PATENT DOCUMENTS

JP 2013014956 1/2013

OTHER PUBLICATIONS

Technical Digest 6, Design of Steel Joist Roofs to Resist Uplift Loads by Steel Joist Institute. Apr. 2012. Sixth Edition.

*Primary Examiner* — Adriana Figueroa
(74) *Attorney, Agent, or Firm* — Moore & Van Allen PLLC; Jeffrey R. Gray

(57) ABSTRACT

The invention relates to panelized system for a structure. The panelized system typically comprises a plurality of joists structured to be operatively coupled to one or more support members of the structure. Each of the plurality of joists are associated with a joist seat comprising a toe and one or more joist apertures. Typically, at least one or more of a plurality of joist seats are operatively coupled to the one or more support members using a toe weld between the toe and the one or more support members. However, an aperture weld between the one or more joist apertures and the support members is omitted. Moreover, a fastener between the one or more joist apertures and the support members is also omitted.

18 Claims, 10 Drawing Sheets

(56) References Cited

U.S. PATENT DOCUMENTS

| | | | | |
|---|---|---|---|---|
| 8,230,657 | B2 * | 7/2012 | Studebaker | F16B 5/0275 52/319 |
| 8,245,480 | B2 * | 8/2012 | Studebaker | E04B 5/40 52/236.6 |
| 8,555,592 | B2 * | 10/2013 | Daudet | E04B 1/2403 52/489.1 |
| 8,621,806 | B2 * | 1/2014 | Studebaker | E04B 5/40 52/319 |
| 8,661,755 | B2 * | 3/2014 | Studebaker | E04B 5/29 52/414 |
| 9,708,813 | B2 | 7/2017 | Mochizuki et al. | |
| 2005/0204690 | A1 | 9/2005 | Ishihara | |
| 2009/0193750 | A1 * | 8/2009 | Klima | E04B 2/96 52/712 |
| 2013/0008112 | A1 | 1/2013 | Studebaker et al. | |
| 2018/0135293 | A1 * | 5/2018 | Daudet | E04B 2/768 |

* cited by examiner

SLOTTED JOIST SEAT STRUCTURE AND METHODS OF DESIGNING AND BUILDING THE STRUCTURE

FIELD

This application relates generally to the field of structural decking systems, and more particularly to structural roof and/or floor panel systems for buildings with improved joist seat connections and design and assembly methods thereof.

BACKGROUND

Structural wall, roof, or floor panels (collectively "structural panels") are used in commercial or industrial construction (and in some cases residential construction), for example, in commercial buildings, industrial buildings, institutional buildings, or the like. Structural panels, may be typically manufactured from steel sheets, which may or may not be coiled. In order to increase the structural strength and the stiffness of the individual steel sheets, structural panels with longitudinal flutes are formed from the steel sheets via roll forming, break forming, bending, stamping, or other like processes. The structural panels are secured to each other in order to form a structural panel system when installed (e.g., wall system, roof system, floor system, or combination thereof). The structural panels are also connected to the other load resisting structural support members of a building, such as joists, which in turn are secured to support beams through the use of joist seats on the joists. In some situations the joists may be utilized to form panelized systems that are then lifted onto a structure. These structures formed by panelized systems, or otherwise installed directly on the structures, must resist wind, earthquake (in some locations), or other loading.

BRIEF SUMMARY

Structural panels utilized within a structural panel system of a building typically include longitudinal flutes (e.g., upper flange, lower flange, and webs that form a single flute as discussed in further detail later) that extend longitudinally along the length of the panel in order to provide structural strength to the panels, and thus, to the structural panel system and to the structure. The structural panels typically comprise two edges and two ends. The edges of structural panels extend parallel with the longitudinal flutes, while the ends of the structural panels extend perpendicular (or transverse) to the longitudinal flutes. As such, one edge of the structural panels may be described as a "first edge" (or a "top edge" or "left edge") while the second edge of the structural panels may be described as a "second edge" (or a "bottom edge" or "right edge"). The ends of the structural panels may be described as a "first end" (or a "top end" or "left end") and a "second end" (or a "bottom end" or "right end"). The structural panels are operatively coupled together (e.g., through sidelaps at the edges, or the like) and to a plurality of joists, which are operatively coupled to support members (e.g., support beams) to form structural decking systems. In some embodiments portions of the structural decking systems, called panelized systems (e.g., joists, joist seats, bridging, structural decking panels, or the like), may be assembled before being hoisted into place.

Embodiments of the present invention relate to a panelized system for structural decking systems for a structure. The panelized system typically comprises a plurality of joists operatively coupled together, which is structured to be operatively coupled to one or more support members (e.g., beams, or the like) of a structure. The plurality of joists may comprise a joist seat comprising a toe and one or more joist apertures. As will be described herein, at least one or more of a plurality of joist seats are operatively coupled to the one or more support members of the structure using a toe weld between the toe and the one or more support members. However, aperture connections (e.g., aperture weld, fastener, or the like) between the one or more joist apertures and the support members are omitted. Moreover, in some embodiments, such as adjacent the ends of support members, the joist seats may be operatively coupled to the one or more support members using an aperture connection (e.g., aperture weld, fastener, or the like), with or without a toe weld, for example, in order to provide the desired strength to a panelized system.

Specifically, with respect to the one or more joist seats that are operatively coupled to the one or more support members using only a toe weld and omitting an aperture connection between the one or more joist apertures and the support members, the toe weld may be sized based on the one or more joist apertures. For example, the at least one toe of the joist seat is welded along a predetermined length of anchorage or toe weld length, which is configured to provide the same (or greater) anchorage, uplift capacity and rollover capacity for the joist seat having one or more apertures, as would be obtained for unslotted type joist seats or joist seats whose apertures are welded or otherwise operatively coupled to the support members of the structure through another aperture connection (e.g., fastener, or the like). Moreover, in some embodiments the toe weld length is greater than the length of the one or more joist apertures.

In some embodiments, a panelized system may be preformed before installation into a structure. The panelized system may include at least a plurality of joists. In some embodiments, the plurality of joists comprise a plurality of joist seats having one or more toes and one or more joist apertures. Typically, at least one of the plurality of joist seats are structured to be operatively coupled to one or more support members of the structure using a toe weld between the one or more toes and the one or more support members. Here, an aperture connection between a joist aperture and a support member is omitted.

In some embodiments each of the joists have joist seats with one or more apertures, such that any joist may be utilized in any location in the panelized system for ease of assembly. In some embodiments, the plurality of joists may comprise a first end joist, a second end joist and one or more intermediate joists, which may or may not be assembled within a jig to form the panelized system. In some embodiments, bridging and/or structural decking may be assembled between the joists to create the panelized systems. As such, the first and second end joists may be structured to be operatively coupled to opposite ends of each of two or more support members of the structure (e.g., when the panelized assembly is hoisted onto the structure). Next, the panelized system may be hoisted onto the structure comprising one or more support members. In some embodiments, the first end joist of the plurality of joists is assembled adjacent a first end of the one or more support members using one or more end joist seats. Similarly, the second end joist of the plurality of joists may be assembled adjacent a second end of the one or more support members using the one or more end joist seats. Typically, assembling the first end joist and/or the second end joist comprises making an aperture connection between the one or more end joist seats and the one or more support. In some embodiments, the one or more intermediate joists of the plurality of joists are assembled to the one or more support members between the first end and the second end of the one or more support members using one or more intermediate joist seats. Assembling the one or more intermediate joists comprises welding one or more toes of the one or more intermediate joist seats of the one or more intermediate joists to the one or more support members. Moreover, the aperture connection between the one or more joist apertures of the one or more intermediate joist seats and the one or more support members is omitted.

As such, in some embodiments or in combination with any of the above embodiments, the plurality of joists and plurality of joist seats comprise: two end joists each comprising one or more end joist seats; and one or more intermediate joists each comprising one or more intermediate joist seats. Typically, the one or more joist apertures of the one or more end joist seats are configured for operative coupling to the one or more support members through the use of the aperture connection. Moreover, typically the aperture connection between the one or more joist apertures of the one or more intermediate joists seats and the one or more support members is omitted.

In some embodiments or in combination with any of the above embodiments, the toe weld length is greater than a length of the one or more joist apertures. As discussed, the toe weld is typically formed after the panelized system is hoisted onto the structure.

In some embodiments or in combination with any of the above embodiments, the toe weld length is configured to provide at least a predetermined ultimate uplift strength to the at least one or more of the plurality of joist seats. Typically the predetermined ultimate uplift strength is the ultimate uplift strength obtained if the aperture connection between the one or more joist apertures and the support members is not omitted.

In some embodiments or in combination with any of the above embodiments, the toe weld length is equal to at least about two times the length of the one or more joist apertures.

In some embodiments or in combination with any of the above embodiments, bridging is operatively coupled to two or more of the plurality of joists.

In some embodiments or in combination with any of the above embodiments, structural decking operatively coupled to the plurality of joists, before, after or during forming the toe weld, as discussed above.

In some embodiments or in combination with any of the above embodiments, a method for forming a structural decking system using a panelized system comprises constructing a panelized system comprising a plurality of joists, wherein the plurality of joists comprise joist seats having one or more toes and one or more joist apertures, wherein the plurality of joists comprises a first end joist, a second end joist and one or more intermediate joists. Next, the panelized system may be hoisted onto a structure comprising one or more support members. Subsequently, the first end joist of the plurality of joists may be assembled adjacent a first end of the one or more support members using one or more end joist seats, e.g., by making an aperture connection between the one or more end joist seats and the one or more support members. Similarly, the second end joist of the plurality of joists may be assembled adjacent a second end of the one or more support members using the one or more end joist seats, e.g., by making an aperture connection between the one or more end joist seats and the one or more support members. One or more intermediate joists of the plurality of joists may also be assembled to the one or more support members between the first end and the second end of the one or more support members using one or more intermediate joist seats. Typically, this involves welding one or more toes of the one or more intermediate joist seats of the one or more intermediate joists to the one or more support members, such that the aperture connection between the one or more joist apertures of the one or more intermediate joist seats and the one or more support members is omitted.

In some embodiments or in combination with any of the above embodiments, a method for designing a structure comprises determining one or more support members for a structure, determining one or more end joists for the structure having one or more end joist seats having one or more joist apertures and/or determining one or more intermediate joists for the structure having one or more intermediate joist seats having the one or more joist apertures. Moreover, the method further comprises determining a toe weld length for one or more toes of one or more intermediate joist seats for one or more intermediate joists that allows for omission of an aperture connection between the one or more joist apertures of the one or more intermediate joists and the one or more support members. As discussed above, typically, the toe weld length is equal to at least about two times a length of the one or more joist apertures.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Figure 1A:
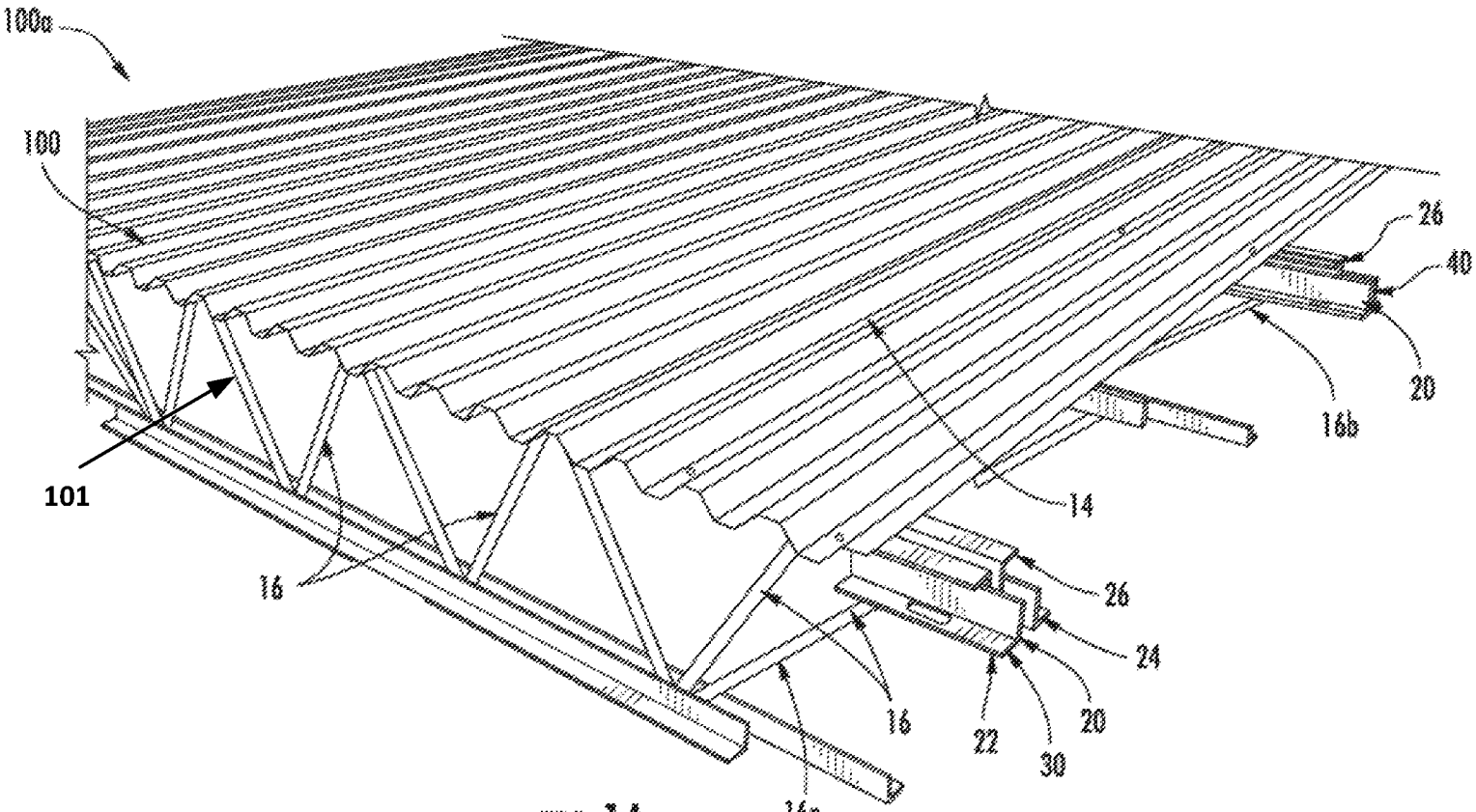
FIG. 1A illustrates a perspective view of a structural decking system 100, in accordance with some embodiments of the invention.

Embodiments of the present invention may now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

As discussed, "support members" or "support structures", as used herein, may refer to structural wall, roof, or floor structures or components that are used in construction of buildings or dwellings, such as commercial or industrial construction, residential construction. In some embodiments, support members refer to one or more of primary support members of a building, such as those that provide support for the floors and/or ceilings (e.g., beams, joist girders, purlins, masonry walls, concrete walls, cold-formed wall studs, wood load bearing wall studs, trusses, frames, columns and/or the like). Here, the support members may be manufactured from metals, alloys, non-metals or composites and may comprise suitable cross-sections, shapes and dimensions.

The support members are secured to each other in order to form a support system when installed (e.g., wall system, roof system, floor system, or combination thereof). The support members are coupled together through the use of a plurality of joists through the use of one or more "joist seats" (also referred to as "joist shoes") on the joists. In some situations the joists may be secured to the support members in various ways to form panelized systems that are then lifted onto structures having one or more support members. These structures, formed by panelized systems or otherwise installed directly, must resist wind, earthquake (in some locations), or other loading.

In some embodiments, decking panels are operatively coupled to the plurality of joists. The decking panels are manufactured from steel sheets. In order to increase the structural strength and the stiffness of the individual steel sheets and the structural decking system, decking panels with longitudinal flutes may be formed from the steel sheets via roll forming, break forming, bending, stamping, or other like processes. Moreover, the decking panels may comprise flutes of corrugations of suitable dimensions and corrections (e.g., V-shape, dovetail shape, W-shape, U-shape, or other like profile shape).

The panelized system comprises the plurality of joists, the bridging, and the structural decking panels that may be pre-assembled before being hoisted and installed into a structure having one or more support members. The panelized system is coupled to the structure (e.g., one or more support members such as beams, columns, walls, or the like) and/or other panelized systems to form the structural decking system (e.g., building or the like). The present invention provides optimal (e.g., equivalent, enhanced, or the like) uplift and rollover capacity for these panelized systems in particular and the structural decking system in general, without adding undue time intensive and expensive construction and assembly steps. In particular, in some embodiments, the present invention provides the ability to use a single type of joist and joist seat in the panelized system, and thus in the structural decking system, along with a unique welding process for the intermediate joists, which obviates the need for unwieldy, time intensive and cumbersome steps of welding or other aperture connection (e.g., using fasteners such as bolts, or the like) for the joist seats. In some embodiments, the systems of the present invention provide the same or increased uplift and rollover capacity in comparison with structures having aperture connections between the joist seats and the support members, while providing improved assembly. Moreover, in some embodiments, the present invention allows for the use of a single type of joist (e.g., slotted joists, or joists with other types of apertures) through the entire panelized system and/or the structural decking system without having to make connections at each of the one or more joist apertures of each of the joist shoes.

FIG. 1A illustrates a perspective view 100A of a panelized system 101 for a structural decking system 100, in accordance with some embodiments of the invention. The structural decking system 100 typically comprises a structure having one or more support members (not illustrated in FIG. 1A) and a panelized system 101 comprising a plurality of joists 16. In some embodiments, the one or more support members of the structure may comprise beam type (I-beam) support members (illustrated by FIG. 1B). In some embodiments, the panelized system 101 comprises a plurality of joists 16, a plurality of joist seats 20, one or more structural decking panels 14, and/or bridging between the joists (not illustrated). Typically, a pair of the support members may be operatively coupled using one or more joists 16 extending between the support members, through the use of one or more joist seats 20 for each joist, (e.g., when the panelized system having the joists 16 is lifted onto the structure having the support members). The one or more joist seats 20 may be suitably oriented, positioned and spaced apart for coupling the pair of the support members to provide the desired structural support for decking panels 14 and/or concrete located above the decking panels 14. Typically, at least portions of the joist seat(s) 20 are operatively coupled (using welding, brazing, coupling using fasteners such as bolts, or otherwise attaching, joining or connecting) to one or both of the pair of the support members for coupling the pair of the support members.

Moreover, each of the joist seat(s) 20 may comprise one or more angle portions (22, 24) (e.g., a pair of angle portions (22, 24)) which may be operatively coupled to each other via a component 18 (e.g., a joist seat plate, portion of one of the joist 16 between them, or the like). The angle portions (22, 24) may comprise a suitable cross-section, such as a substantially "C" shape, a "L" shape, a "V" shape, "U" shape, and the like. In the embodiment illustrated in FIG. 1A, each of the angle portions (22, 24) of the joist seat(s) 20 comprise an "L" shape. As such, the angle portions 22 and 24 are operatively coupled to each other and to an upper chord 26 (e.g., also comprising of two "L" shaped angles, or the like), as will be described in detail with respect to FIGS. 1B-1D below.

The one or more joists 16 each with one or more joist seats 20 (a joist seat on each opposing end of each of the joist seat, or the like) may comprise one or more end joists 16*a*, each positioned adjacent to an end of the one or more support members (e.g., proximate the ends of the each of the support members). In some embodiments, the one or more end joists 16*a*, comprise two end joists 16*a* each with end joist seats 30 positioned at opposite ends of each of the two end joists 16*a*. Each of the end joists 16*a* is operatively coupled to adjacent the ends of the support members, through the use of the end joist seats 30. Moreover, the one or more joist seats 20 may further comprise one or more intermediate joists 16*b* each with one or more intermediate joists seats 40 on opposite ends of the intermediate joists 16*b*. Each of the one or more intermediate joists 16*b* are positioned away from an end of the one or more support members in comparison with the one or more end joists 16*a* (e.g., spaced between the end joists 16*a*). In other words, a distance between an intermediate joist 16*b* and an end of a support member may be greater than a distance between an end joist 16*a* and an end of the support member. As illustrated by FIG. 1A, in the embodiments where the one or more joists 16 comprise two end joist 16*a*, the one or more intermediate joists 16*b* are positioned in between the two end joists 16*a*, and as such the one or more intermediate joist seats 40 are positioned between the two end joist seats 30.

Figure 1B:
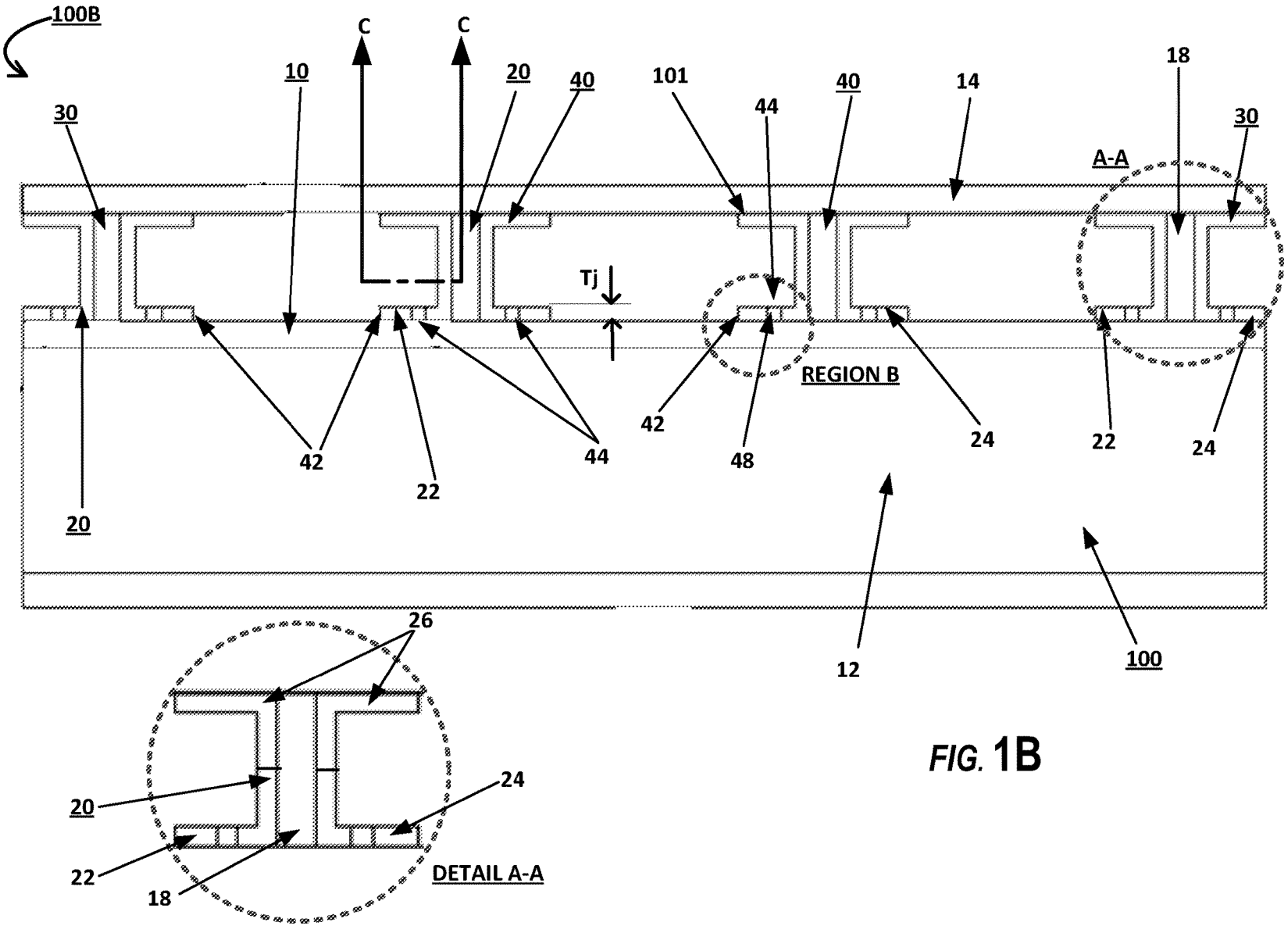
FIG. 1B illustrates a cross-sectional view of a structural decking system 100, in accordance with some embodiments of the invention.

FIG. 1B illustrates a cross-sectional view 100B of a structural decking system 100, in accordance with some embodiments of the invention. As discussed, the structural decking system 100 typically comprises a structure having one or more support members 10 and a panelized system 101 comprising a plurality of joists 16 (illustrated in FIG. 1A). In some embodiments, the one or more support members 10 of the structure comprise a first support member 12 and a second support member (not illustrated, located on the opposite end the joists 16). In some embodiments, the first support member 12 and the second support member may be beam type (I-beam) support members, as illustrated by FIG. 1B. In other embodiments, the one or more support members 10 may comprise any suitable support member or a suitable combination of support members (e.g., bricks, concrete, rolled studs, columns, wood, or the like). In some embodiments, the panelized system 101 comprises a plurality of joists 16 (illustrated in FIG. 1A), a plurality of joist seats 20, one or more structural decking panels 14, and/or bridging between the joists (not illustrated, but may include one or more bridging angles, such as single angles or multiple angles operatively coupled together, similar to a chord or joist shoe of the joists). Typically, a pair of the support members may be operatively coupled using one or more joists 16 (illustrated in FIG. 1A) extending between them, through the use of one or joist seats 20 for each joist (e.g., when the panelized system having the joists 16 is lifted onto the structure having the support members). The one or more joist seats 20 may be suitably oriented, positioned and spaced apart for coupling the pair of the support members (or a support member and a decking panel 14) to provide the desired structural support for decking panels 14 and/or concrete 8 located above the decking panels 14 (illustrated in FIG. 1A). As discussed, at least portions of the joist seat(s) 20 are operatively coupled (using welding, brazing, coupling using fasteners such as bolts, or otherwise attaching, joining or connecting) to one or more of the support members 10 for coupling the support members 12 (e.g., when the panelized system having the joists 16 is lifted onto the structure having the support members). In some embodiments, the one or more ends of the joist seat(s) 20 maybe operatively coupled (e.g., welded) to one or more of the support members 10. In some embodiments, the one or more ends of the joist seat(s) 20 are operatively coupled (e.g., welded) to the support member(s) 12 at an interface formed between a portion of a joist seat 20 and a corresponding adjacent portion of a support member 12, such as at an interface formed where a surface or an edge (e.g., toe 42) of the joist seat 20 contacts or meets a surface of the corresponding support member 12.

Moreover, each of the joist seat(s) 20 may comprise one or more angle portions (22, 24) (e.g., a pair of angle portions (22, 24)) which may be operatively coupled to each other via a component 18 between them. The component 18 may refer to a seat plate, a portion of a joist 16 (e.g., a web, a chord, or another component), or the like. The angle portions (22, 24) may comprise a suitable cross-section, such as a substantially "C" shape, a "L" shape, a "V" shape, "U" shape, and the like. In the embodiment illustrated in FIG. 1B, each of the angle portions (22, 24) of the joist seat(s) 20 comprise an "L" shape, as indicated by Detail A-A. As such, the angle portions 22 and 24 are operatively coupled to each other and to an upper chord 26 (e.g., also comprising of two "L" shaped angles, or the like) via the component 18. The angle portions 22 and 24 may be operatively coupled to the support member 12 through at least a point of contact. In other embodiments not illustrated herein, the angle portions 22 and 24 of the joist seat(s) 20 may comprise a "C" shape. Here, the angle portions 22 and 24 may be operatively coupled to each other via the component 18, and operatively coupled to the support member(s) 12 proximate the point of contact.

As discussed above, the one or more joists 16 each with one or more joist seats 20 (a joist seat on each end) may comprise one or more end joists 16*a* with one or more joist seats 30 (illustrated in FIG. 1A), each positioned adjacent to an end of the one or more support members 10 (e.g., proximate the ends of the each of the support members 10). In some embodiments, the one or more joists 16, comprise two end joists 16*a* each with an end joist seat 30 positioned at opposite ends of each of the two end joists 16*a* (illustrated in FIG. 1A). Each of the end joists 16*a* (illustrated in FIG. 1A) are operatively coupled to adjacent the ends of the support members 10, through the use of the end joist seats 30, as illustrated by FIG. 1B. Moreover, the one or more joist seats 20 may further comprise one or more intermediate joists 16*b* (illustrated in FIG. 1A) each with one or more joists seats 40 on opposite ends of the intermediate joists 16*b*. Each of the one or more intermediate joists 16*b* are positioned away from an end of the one or more support members 10 in comparison with the one or more end joist 16*a* (e.g., between the end joists 16*a*). In other words, a distance between an intermediate joist 16*b* and an end of a support member 10 may be greater than a distance between an end joist 16*a* and an end of the support member 10. In the embodiments where the one or more joist 16 comprise two end joist 16*a*, the one or more intermediate joist 16*b* are positioned in between the two end joist 16*a*, and as such the one or more intermediate joist seats 40 are positioned between the end joists seats 30. As used herein, unless otherwise specified, one or more joist seats 20 (or joist seat 20) may refer to one or more end joist seats 30 and/or one or more intermediate joist seats 40.

In conventional structure assemblies, the end joist seats may be slotted type joist seats that comprise one or more joist apertures 48 (e.g., circular apertures, square apertures, or slotted apertures of different shapes, such as oval, rectangular, or the like) while the intermediate joist seats are unslotted type joist seats which do not comprise the one or more joist apertures. Both of the slotted type and unslotted type joist seats are required to be welded at their end portions or edges to couple the joist seats with the one or more support members. Moreover, the joist apertures of the end joist seats 30 are typically required for operatively coupling the end joist seat adjacent an end of structure support member(s) 12, using fasteners such as bolts, studs and nuts, or the like. Employing these different types of joist seats exacerbates the complexity and costs of the structure and the time it takes to assemble the structure, such as the pre-assembled panelized systems. For example, the different types of joists (e.g., slotted, unslotted) must be manufactured and shipped, and during assembly, the correct joists must be located in the correct locations of the structure, such as within the pre-formed panelized system. Hence, it is advantageous to employ a single type of joist seat 20 on each of the joists 16 throughout the structural decking system. However, employing joist seats with one or more joist apertures (e.g., slotted type joist seats) at the intermediate joist seats locations, adversely affects the uplift capacity and roll over capacity of the structure assembly, particularly due to the lack of anchorage at the joist apertures (e.g., at the slotted apertures in the intermediate joists). Accordingly, if joist seats 20 with one or more joist apertures are utilized as intermediate joist seats in conventional systems, it would necessitate operatively coupling (e.g., by welding and/or fastening) each of the one or more apertures of each of the joist seats 20 to the corresponding support member, to provide the required uplift anchorage. However, the apertures (e.g., slots, or the like), particularly those in the intermediate joist seat 40 locations, are difficult to access and maybe unreachable for the coupling tools (e.g., welding tools, pneumatic or hydraulic wrenches, or the like) making the operative coupling of the intermediate joist seat 40 to the support members 10 through the one or more joist apertures challenging, if not impossible. For instance, Region B of FIG. 1B illustrates an intermediate joist seat 40 having one or more joist apertures 44 (e.g., multiple apertures on a side and/or on both sides of the joist seat 20), such as a slotted joist seat type having one or more slotted apertures. As illustrated, the arrangement of the structural decking system 100 itself and the structural decking panel(s) 14 in particular, at least partially cover and obscure one or more joist apertures 44. Operatively coupling the aperture(s) 44 to the support member 12 (e.g., by welding) at the interface portions 48 may be challenging, because of the lack of access and lack of maneuverability of certain coupling tools/devices in the narrow confined space at and around the aperture(s) 44 (particularly in the instances where the structural decking 14 is assembled prior to welding). Moreover, operatively coupling (e.g., by welding and/or fastening) each of the one or more apertures of each of the slotted type joist seats, even if possible (e.g., due to the configuration of the joist seat and/or because of installed decking), again adds to the complexity, time consumption and costs of assembling the structure.

The present invention alleviates the above drawbacks and provides additional advantages, as will be described herein. Embodiments of the present invention provide the required anchorage, uplift capacity and rollover capacity for the panelized system, without requiring operative coupling of the joist apertures of the intermediate joist seats 40 and without requiring use of unslotted type joist seats (e.g., a single type of joist seat may be utilized throughout the structural decking system 100). Moreover, in some embodiments, the present invention allows for use of the same type of joist seats (e.g., slotted type joist seats) uniformly for the panelized system without adversely affecting the anchorage, uplift capacity and rollover capacity of the panelized system, and in some embodiments improving the anchorage, uplift capacity and rollover capacity.

Returning to FIG. 1B, each of the one or more joist seats 20 of the panelized system typically comprise at least one toe 42. For example, each of the angled portions (22, 24) comprises a toe 42. The toe 42 may comprise an edge of the angled portion (22, 24). The one or more joist seats 20 are positioned or arranged such that a surface of the toe 42 is substantially perpendicular with the corresponding support member 12, such that at least a portion of the toe 42 contacts a surface of the support member 12. As illustrated by FIG. 1B, each of the one or more joist seats 20 and particularly the one or more angled portions (22, 24) of the joist seats 20 may comprise one or more joist apertures 44 (e.g., slots, or the like). However, it is contemplated that in alternative embodiments the one or more joist seats 20 may comprise more or fewer apertures than those illustrated herein (e.g., multiple apertures on each angle, or a single aperture on one angle and no aperture on an adjacent angle). Each joist aperture 44 may comprise an aperture depth "Tj", which may be the same as a thickness of the angled portion (22, 24). The present invention provides a unique joist seat design and method of coupling which provides the required anchorage, uplift capacity and rollover capacity for the panelized system (or improves upon the forgoing) by uniquely operatively coupling the joist seat(s) 20 at toe(s) 42 (or at least one toe 42), without requiring operative coupling at the one or more joist apertures 44 (e.g., welding at portions 48 of the aperture(s) 44, or the like) of the intermediate joists 16*b*. The one or more joist seats 20 will be described in detail with respect to section C-C illustrated in FIG. 2.

Figure 1C:
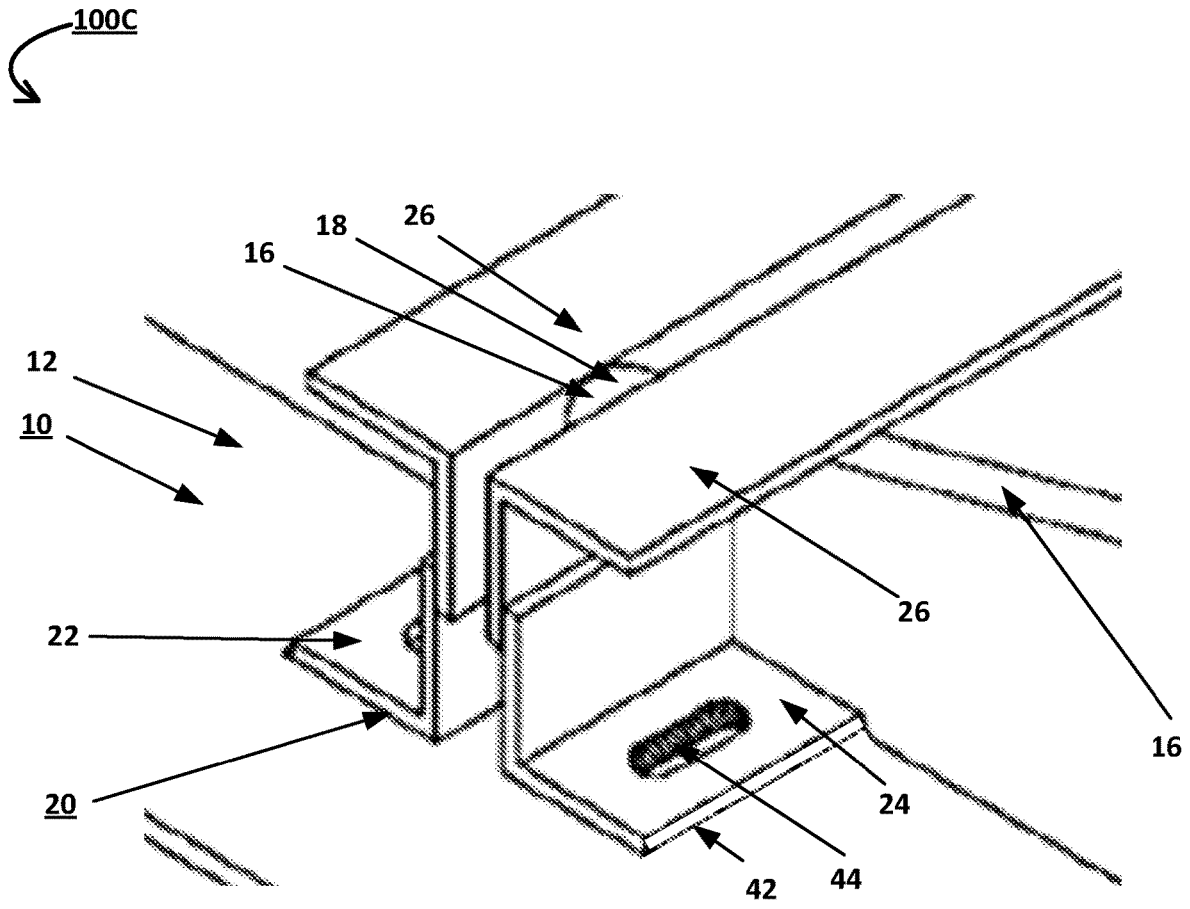
FIG. 1C illustrates a cut-away perspective view of a panelized system, in accordance with some embodiments of the invention.

FIG. 1C illustrates a cut-away perspective view 100C of a structural decking system 100, in accordance with some embodiments of the invention. As discussed, each of the joist seat(s) 20 may comprise one or more angle portions (22, 24) (e.g., a pair of angle portions (22, 24)) which may be operatively coupled to each other via a component 18 (e.g., a portion of a joist 16, a seat plate, or the like) between them. In the embodiment illustrated in FIG. 1C, each of the angle portions (22, 24) of the joist seat(s) 20 comprise an "L" shape. The angle portions 22 and 24 are operatively coupled to an upper chord 26 (e.g., also comprising of two "L" shaped angles, or the like). Moreover, a web of the joist 16 is used to operatively couple the angles of the upper chord 26, and in some embodiments the angle portion 22 and 24 of the joist seat 20. As illustrated by FIG. 1C, an end portion of an "L" shaped angle of the upper chord 26 may overlap over a portion of a corresponding angle portion (22, 24) of the joist seat 20.

Figure 1D:
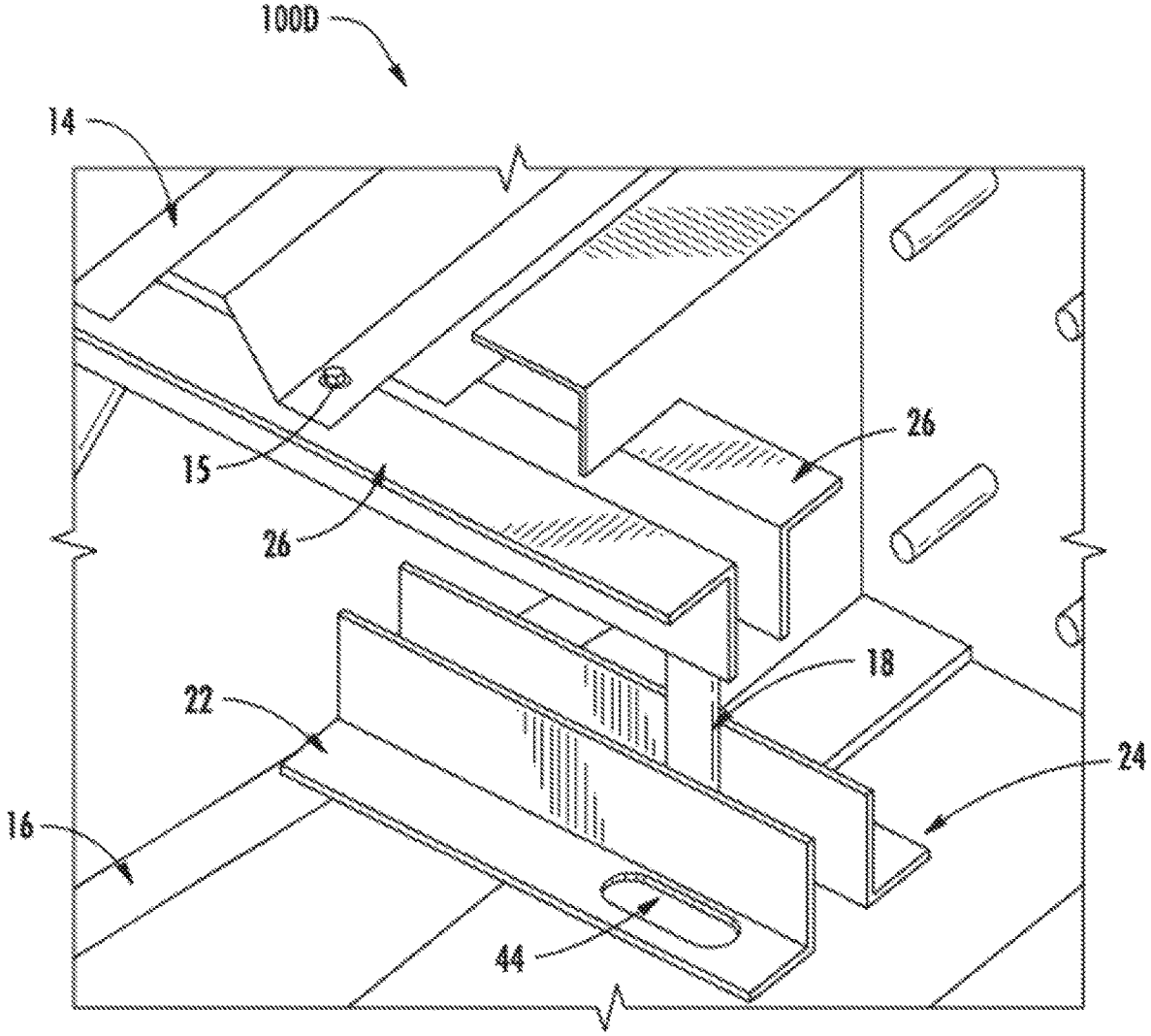
FIG. 1D illustrates a cut-away perspective view of a panelized system, in accordance with some embodiments of the invention.

FIG. 1D illustrates a cut-away perspective view 100D of a structural decking system 100, in accordance with some embodiments of the invention. As discussed, each of the joist seat(s) 20 may comprise one or more angle portions (22, 24) (e.g., a pair of angle portions (22, 24)) which may be operatively coupled to each other via a component 18 (e.g., a portion of the joist 16) between them. In the embodiment illustrated in FIG. 1D, each of the angle portions (22, 24) of the joist seat(s) 20 comprise an "L" shape. Here, the angle portions 22 and 24 are operatively coupled to each other and to an upper chord 26 (e.g., also comprising of two "L" shaped angles, or the like) via the component 18. As illustrated by FIG. 1D, an end portion of an "L" shaped angle of the upper chord 26 may be spaced apart from an end portion of a corresponding angle portion (22, 24) of the joist seat 20, via the component 18.

Figure 2:
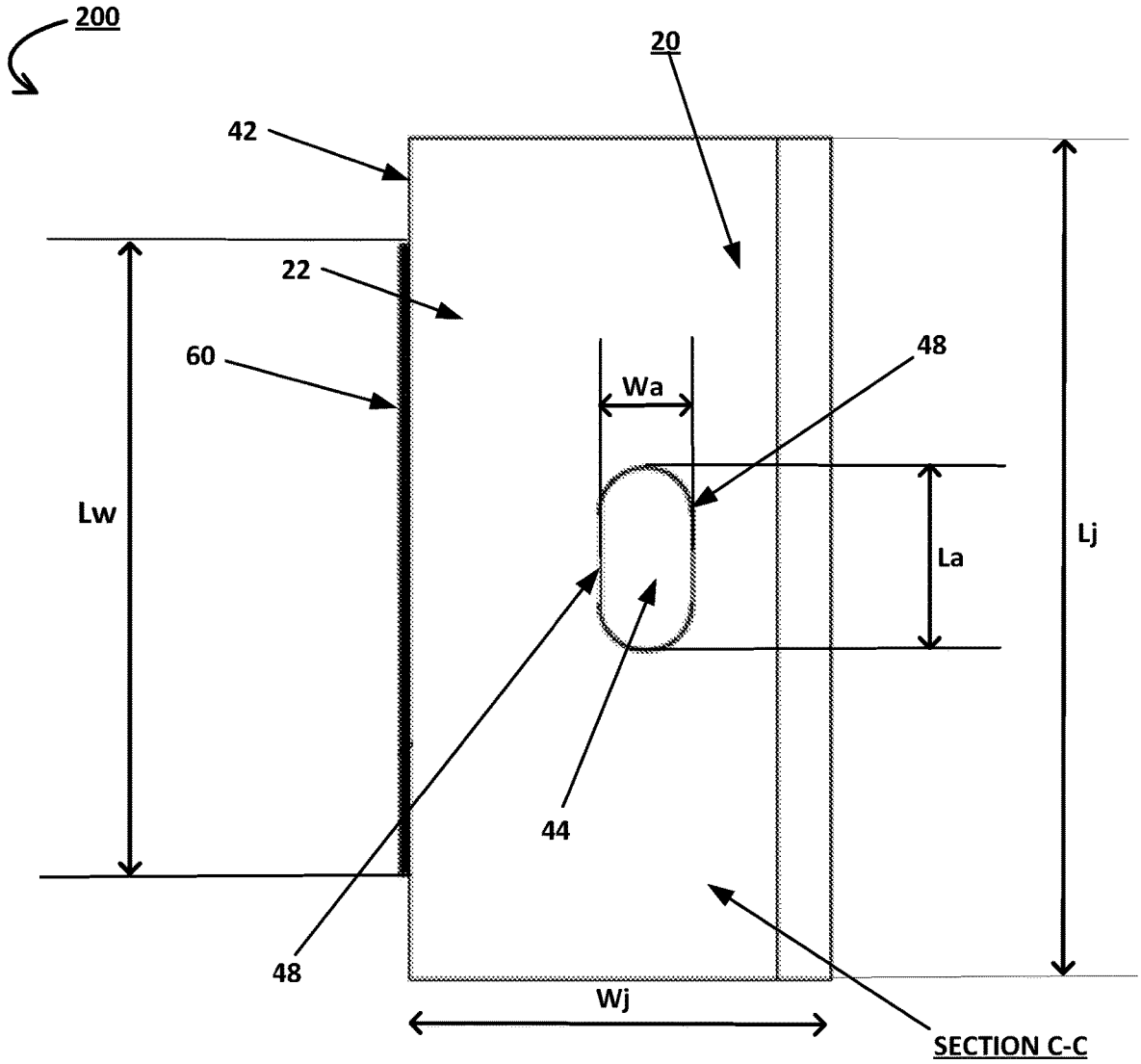
FIG. 2 illustrates a cross-sectional top view of a joist seat of FIG. 1B, in accordance with some embodiments of the invention.

FIG. 2 illustrates a cross-sectional view 200 of a joist seat 20 with respect to section C-C of FIG. 1B, in accordance with some embodiments of the invention. As discussed, joist seat 20 comprises one or more angle portions such as angle portion 22 having a toe 42 and one or more joist apertures, such as joist aperture 44. The angle portion 22 of the joist seat 20 comprises a length "Lj" and a width "Wj" (described in detail with respect to FIG. 3). The aperture 44 has a length "La" and a width "Wa". In some embodiments, the length La of the aperture 44 may be about 2 inches, in the range of about 1-2 inches, 1-5 inches, 2-6 inches, 0.5-10 inches, or outside, or in-between, or overlapping these ranges or any number within these ranges. In some embodiments, the width Wa of the aperture 44 may be about 0.56 inch, in the range of about 0.1-1 inch, 0.2-0.7 inch, 0.1-2 inches, 0.4-3 inches, 0.5-10 inches or outside, or in-between, or overlapping these ranges, or any number within these ranges. As discussed previously, the present invention provides a unique joist seat design and method of coupling which provides the required anchorage, uplift capacity and rollover capacity for the panelized system by uniquely operatively coupling the joist seat(s) 20 at least along a portion of a length of the toe 42, without requiring operative coupling at the one or more apertures 44 (e.g., welding at portions 48 of the aperture(s) 44). As such, the angle portion 22 may be welded with a weld 60 or otherwise operatively coupled along a predetermined length of anchorage "Lw" (also referred to as a "predetermined length of weld" or "toe weld length") of the toe 44. The predetermined length of anchorage or toe weld length Lw is configured to provide the same (or greater) anchorage, uplift capacity and rollover capacity, without requiring operative coupling at the aperture 44, as that would be obtained if the aperture 44 was operatively coupled instead. The design and configuration of the predetermined length of anchorage or toe weld length Lw will be described below.

Figure 3:
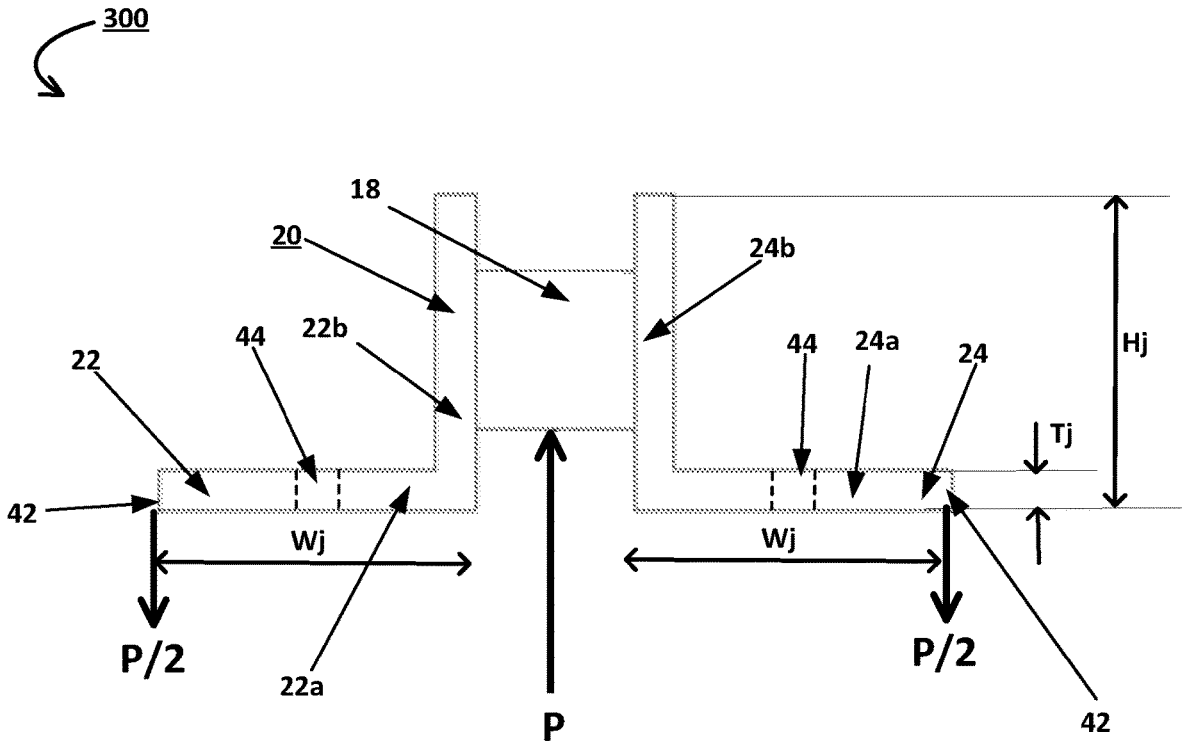
FIG. 3 illustrates a schematic sectional end view of a joist seat, in accordance with some embodiments of the invention.

FIG. 3 illustrates a schematic sectional view 300 of a joist seat 20, in accordance with some embodiments of the invention. The sectional view 300 also depicts a schematic free body diagram representing loading of the joist seat 20 in accordance with some embodiments of the invention. The joist seat 20, in accordance with these embodiments, comprises a pair of angle portions (22, 24), each having a toe 42. The angle portions 22 and 24 are operatively coupled to each other via the component 18. The angle portions (22, 24) comprise a substantially "L" shaped cross section formed by first portions (22*a*, 24*a*) and second portions (22*b*, 24*b*), respectively, as illustrated by FIG. 3. The first portions (22*a*, 24*a*) and second portions (22*b*, 24*b*) form an angle such as a right angle, angles in the range of 80-90 degrees, 60-100 degrees, and the like, or outside, or in-between, or overlapping these ranges or any number within these ranges. However, as discussed previously, in other embodiments not illustrated herein, the angle portions (22, 24) may comprise other suitable cross-sections, such as a substantially "C" shape, a substantially "U" shape, a "V" shape, and the like. As illustrated in FIG. 3, each of the angle portions 22 and 24 of the joist seat 20 may comprise a width "Wj", a height "Hj", a length "Lj" (illustrated in FIG. 2) and a thickness of "Tj". In some embodiments, the width Wj may be about 2 inches, in the range of about 1-2 inches, 2-5 inches, 1-8 inches, 2-10 inches, 2-12 inches, or outside, or in-between, or overlapping these ranges, or any number within these ranges. In some embodiments, the height Hj may be about 2 inches, in the range of about 1-2 inches, 2-5 inches, 1-8 inches, 2-10 inches, 2-12 inches, 2-20 inches, or outside, or in-between, or overlapping these ranges, or any number within these ranges. In some embodiments, the length Lj (illustrated in FIG. 2) may be about 1.5 inch, 3 inches, 10 inches, in the range of about 1-2 inches, 2-5 inches, 2-8 inches, 2-10 inches, 2-20 inches, 2-24 inches, or outside, or in-between, or overlapping these ranges, or any number within these ranges. In some embodiments, the thickness Tj may be about 0.1 inch, 0.13 inch, 0.15 inch, 0.19 inch, 0.25 inch, 0.5 inch, in the range of about 0.01-0.5 inch, 0.01-1 inch, 0.01-2 inches, 0.05-2 inches, 0.05-3 inches or be outside, or in-between, or overlapping these ranges, or any number within these ranges.

In the embodiments where the joist seat 20 has one or more joist apertures, one or both of the angle portions (22, 24) comprise at least one aperture 44 having a length "La", a width "Wa" (illustrated in FIG. 2) and an aperture depth "Tj", as illustrated in FIG. 2. In some embodiments, the length La of the aperture 44 may be about 2 inches, in the range of about 1-2 inches, 1-5 inches, 2-6 inches or outside, or in-between, or overlapping these ranges, or any number within these ranges. In some embodiments, the width Wa of the aperture 44 may be about 0.56 inch, in the range of about 0.1-1 inch, 0.2-0.7 inch, 0.1-2 inches, 0.4-3 inches or outside, or in-between, or overlapping these ranges, or any number within these ranges. In some embodiments, the aperture depth Tj is same as the thickness of the angle portion, while in other embodiments it may vary. As such, the aperture depth Tj may be about 0.1 inch, 0.13 inch, 0.15 inch, 0.19 inch, 0.25 inch, 0.5 inch, in the range of about 0.01-0.5 inch, 0.01-1 inch, 0.01-2 inches, 0.05-2 inches, 0.05-3 inches or be outside, or in-between, or overlapping these ranges, or any number within these ranges.

Typically, load "P" of FIG. 3 represents the ultimate uplift load required for the first portions (22*a*, 24*a*) of the angle portions (22, 24) (e.g., portions proximate the toe 42 or portions operatively coupled to a support member at a region of contact) to yield under the loading P. The force components "P" and "P/2" and their directions as illustrated by FIG. 3 indicate the load balance such that net force is zero. The ultimate uplift load "P" is described in detail below.

Figure 4:
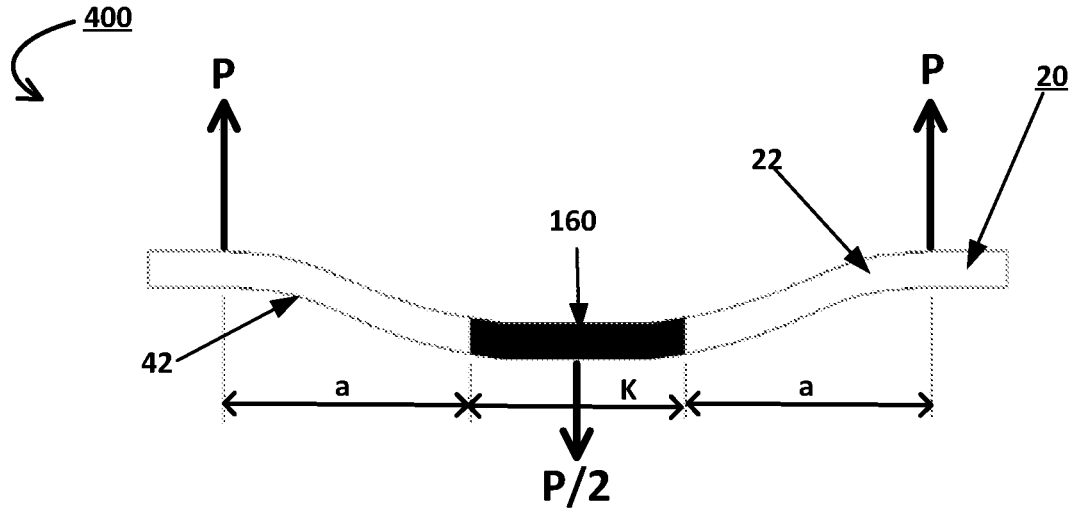
FIG. 4 illustrates a schematic left side sectional view of a joist seat illustrated in FIG. 3, in accordance with some embodiments of the invention.

FIG. 4 illustrates a schematic left side sectional view 400 of the joist seat 20 illustrated in FIG. 3, in accordance with some embodiments of the invention. Specifically, FIG. 4 indicates a length K along which the toe 42 of the angle portion 22 is operatively coupled with a corresponding support member by a weld 160. The length "a" indicates the length of the moment arm when the ultimate uplift load P is applied to the joist seat 20 in accordance with FIGS. 3 and 4. The length "a" may also me defined as a distance between a yield line due to the loading and the toe 42. In some embodiments, length K refers to a length of weld for unslotted type joist seats or joist seats whose apertures are not welded or otherwise operatively coupled (described below) which is required to provide a predetermined uplift capacity P, in other words, withstand an ultimate uplift load P. In some embodiments, the length K refers to a predetermined length of weld.

Figure 5:
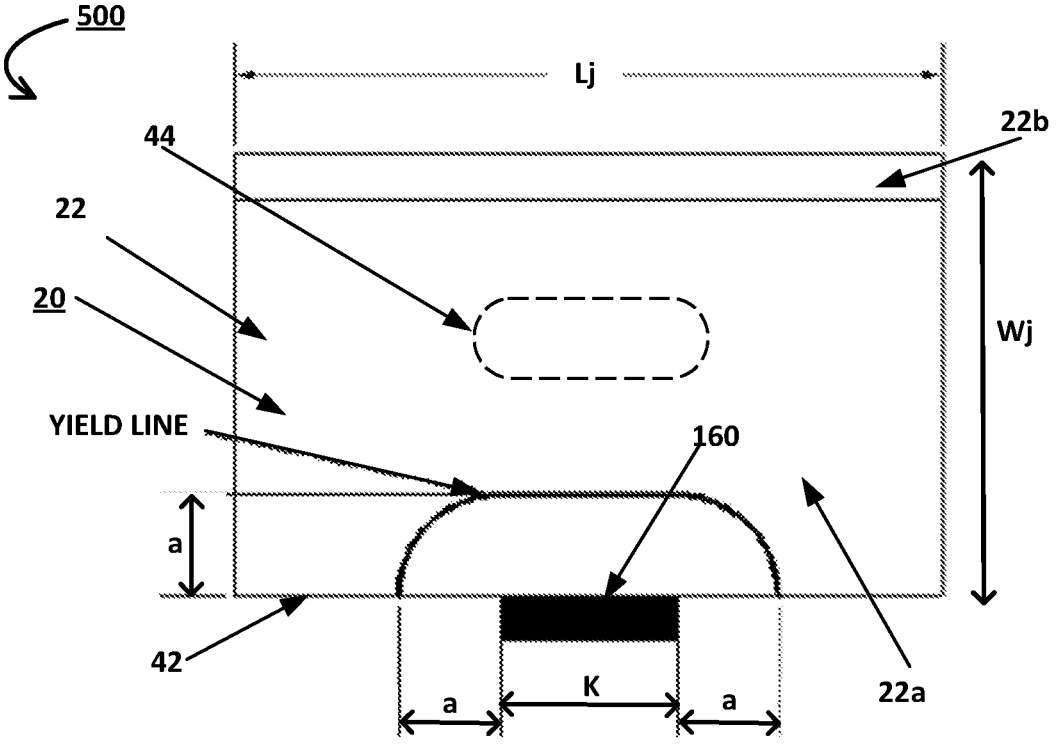
FIG. 5 illustrates a schematic top sectional view of a joist seat illustrated in FIG. 3, in accordance with some embodiments of the invention.

FIG. 5 illustrates a schematic top sectional view 400 of the joist seat 20 illustrated in FIG. 3, in accordance with some embodiments of the invention. Specifically, FIG. 5 indicates a top view of the angle portion 22 being operatively coupled with a corresponding support member by the weld 160 along the length K of the toe 42. As discussed, the length "a" indicates the length of the moment arm when the ultimate uplift load P is applied to the joist seat 20 in accordance with FIGS. 3 and 4. FIG. 5 also indicates the yield line along which the angle portion 22 of the joist seat 20 would yield under the ultimate uplift load P.

Referring to FIGS. 3-5, the ultimate uplift load P is determined to be directly proportional to a product of a plastic moment capacity per unit length "M" of the angle portion 22 and a length "Ly" of the yield line. Moreover, the ultimate uplift load P is inversely proportional to the length of the moment arm "a". Hence, by conservation of momentum, the ultimate uplift load P can be determined as:

$$P = 2\frac{(M)(Ly)}{(a)}$$

Here, it is noted that the plastic moment capacity per unit length M can be determined to be equal to a product of yield stress "Y" of a material from which the angle portion 22 is constructed (e.g., steel) and a plastic section modulus of unit length "Z" of the angle portion 22. For example, yield stress Y of steel may be about 55.7, 57, 58, 60.3, 50-65, 36-80, 50-85 ksi (kilopounds per square inch); 55700, 57100, 58000, 60300, 50000-65000, 36000-80000 psi (pounds per square inch); or outside, or in-between, or overlapping these ranges, or any number within these ranges. Moreover, the plastic section modulus of unit length Z is typically equal to a fourth of a square of the thickness Tj of the angle portion 22. Hence, the plastic moment capacity per unit length M can be determined as:

$$M = (Y)(Z),\ Z = \frac{(Tj)^2}{4}$$

The plastic section modulus of unit length Z may be about 0.0042, 0.005, 0.0009, 0.01, 0.016, 0.005-0.016, 0.005-0.02, 0.002-0.02, 0.002-0.1, 0.002-3 square inches or outside, or in-between, or overlapping these ranges, or any number within these ranges. Moreover, the plastic moment capacity per unit length M may be about 0.2, 0.35, 0.5, 0.9, 0.2-0.9, 0.1-1.5, 0.26-0.9, 0.1-2 kip-in, or outside, or in-between, or overlapping these ranges, or any number within these ranges. Moreover, it is noted that the length Ly of the yield line can be determined to be the lesser of (i) a sum of the length of weld K and perimeter of the curvature with radius a, i.e., (K+πa) and (ii) the length Lj of the angle portion 22 of the joist shoe/seat 20. The determination of "a" and a unique predetermined length of anchorage or toe weld length Lw that is configured to provide the same or greater anchorage, uplift capacity and rollover capacity, without requiring operative coupling at the aperture 44, as that would be obtained if the aperture 44 was operatively coupled instead or if aperture 44 was not present, is described below with respect to FIG. 6.

Figure 6:
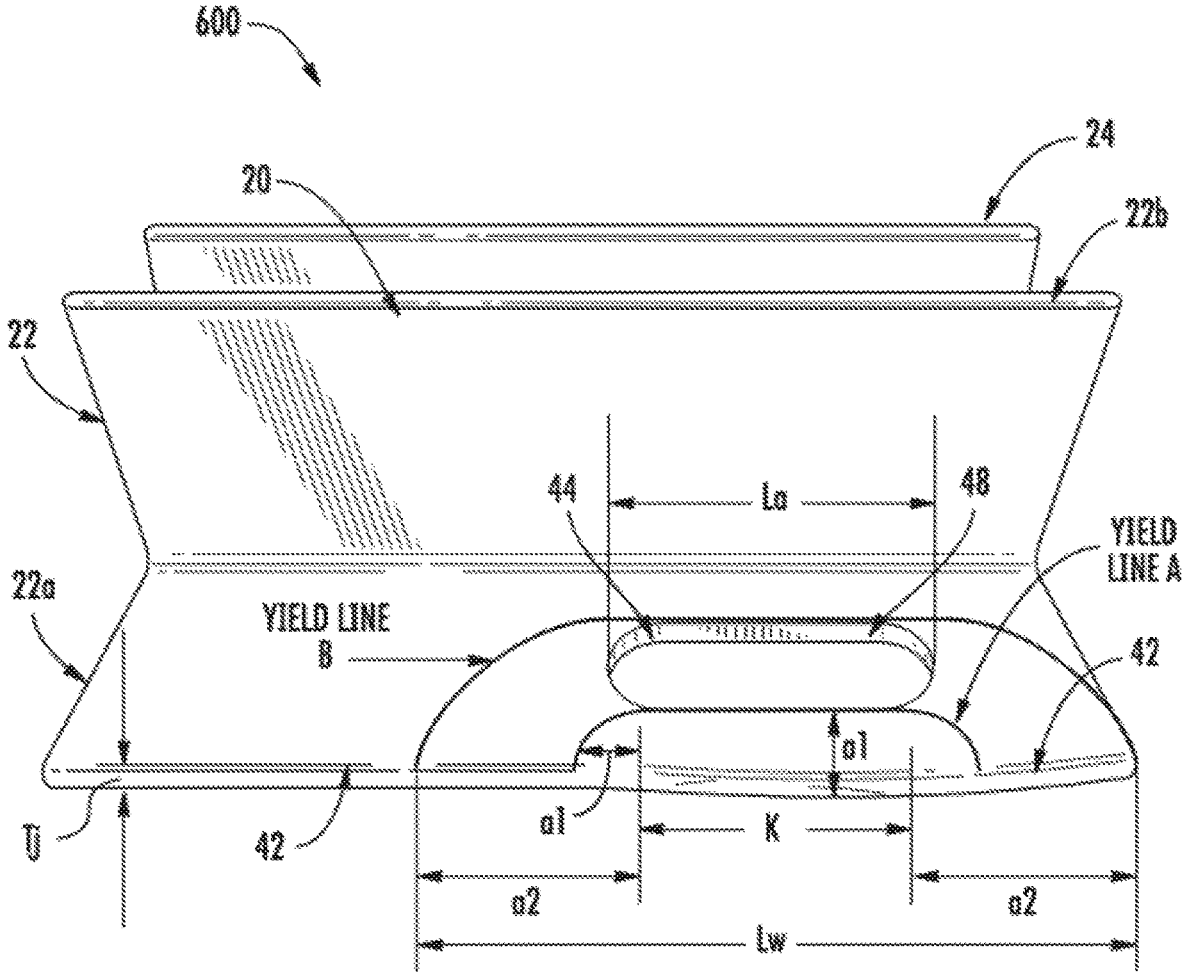
FIG. 6 illustrates a left side perspective view of a joist seat illustrated in FIG. 3, in accordance with some embodiments of the invention.

FIG. 6 illustrates a left side perspective view 600 of the joist seat 20 illustrated in FIG. 3, in accordance with some embodiments of the invention. Specifically, FIG. 6 indicates a first scenario with a length "a1" of the momentum arm and the corresponding yield line A that would result when an unslotted type angle portion 22 (or otherwise an angle portion 22 without an aperture), welded along a length K of toe 42 to a corresponding support member is subject to a ultimate uplift load P. FIG. 6 also indicates a second scenario with a new length "a2" of a momentum arm and the corresponding yield line B that would result when a slotted type angle portion 22 (with aperture 44) welded along the length K and omitting welding in the aperture is subject to the ultimate uplift load P.

In the first scenario involving an unslotted type angle portion 22, it is understood that "unslotted" herein refers to either (i) the angle portion 22 without the aperture 44 or (ii) the aperture 44 of the angle portion 22 also being welded to the corresponding support member along the opening and/or the interface 48 of the aperture 44, in addition to the weld along length K prior to loading. Here, the length a1 of the momentum arm for the unslotted type angle portion 22 is configured to provide a yield line length that predicts the ultimate uplift strength of unslotted type angle portions/joist seats (e.g., when calculated in accordance with the ultimate uplift load P formulation described above). It is noted that, the length a1 of the momentum arm for the unslotted type angle portion 22 is determined to vary in direct proportion with the thickness Tj of the angle portion 22 by a factor of a constant equal to 2.3, based on experimental data at least in part:

$$(a1)=2.3(Tj)$$

Now referring to the second scenario involving a slotted type angle portion having an aperture 44, as discussed earlier, the ultimate uplift strength is inversely proportional to the length of the moment arm. Moreover, slotted type joist seats with angle portions having aperture(s) 44 would have a reduced ultimate uplift strength (i.e. capacity to withstand the ultimate uplift load) due to the larger moment arm a2 in comparison with the length a1 of the momentum arm for the unslotted type. It is contemplated that the ultimate uplift strength of the slotted type angle portions would approach that of an unslotted type as the weld length increases. Here, as the weld length and ultimate uplift strength increase, it is determined that the length of the moment arm a2 would decrease from a maximum value until it reaches the value of that of the unslotted type, as a function of the thickness Tj. This is so because, typically, the ultimate uplift strength of the slotted type may be less than or equal to that of the unslotted type. Specifically, it is determined that, as the weld length and ultimate uplift strength increase, the length of the moment arm a2 would decrease with respect to $f(x)(T\ j)$ until it reaches the value of that of the unslotted type, i.e., a1=2.3 (Tj). Here, $f(x)$ refers to a determined function of variable x, which is a ratio of the length of the weld "K" and the length of the aperture "La". The function $f(x)$ is determine to be:

$$f(x) = (C - 0.25x^2),\ x = \frac{(K)}{(La)}$$

Here, the ratio x of ratio of the length of the weld "K" and the length of the aperture "La" may be about 0.5, 0.6, 0.8, 1, 1.25, 1.5, 0.5-1.6, 0.2-2, 0.1-1.8, 0.2-1.6, 0.5-3, or outside, or in-between, or overlapping these ranges, or any number within these ranges. Moreover, "C" is a constant that may be experimentally determined based on testing. Hence, the length of the moment arm a2 for a slotted type angle portion having aperture(s) is determined to vary as:

$$(a2)=(C-0.25x^2)(Tj)$$

It is further determined, based at least in part on experimental testing, that the constant C has a value of about 4.26. However, the constant C may be about 1, 2, 3, 3.2, 3.5, 3.6, 3.8, 3.9, 4.0, 4.1, 4.2, 4.3, 4.4, 4.5, 4.6, 4.7, 4.8, 4.9, 5.0, 5.2, 5.5, 6, 7, 8, or outside, or in-between, or overlapping these ranges (e.g., 3.5-5, 4.0-4.5, or the like), or any number within these ranges Hence, the length of the moment arm a2 for a slotted type angle portion having aperture(s) is determined to be the maximum of:

$$(a2) = \max \left| \begin{array}{c} (C - 0.25x^2)(Tj) \\ 2.3(Tj) \end{array} \right.$$

In some embodiments, the length of the moment arm a2 for a slotted type angle portions may be about 0.5, 0.6, 0.7, 0.8, 1, 1.2, 1.5, 2 inches, in the range of 0.52-1.07, 0.4-2, 0.5-1.02, 0.52-1.07, 0.5-0.79, 0.8-1.05, 0.5-3 inches, or outside, or in-between, or overlapping these ranges, or any number within these ranges.

Hence, based on the length of the moment arm a2 for a slotted type angle portion above, the predetermined length of anchorage "Lw" ("predetermined length of weld" or "toe weld length") of the toe 44 which is configured to provide the same (or greater) anchorage, uplift capacity and rollover capacity for slotted type angle portions, as that would be obtained for unslotted type angle portions (e.g., no aperture within the angle portion, or for an angle portion whose slots are welded or otherwise operatively coupled to the support member), can be determined to be at least about (2(a2)+K). In some embodiments, the predetermined length of anchorage Lw or toe weld length Lw is determined to be at least about (2(a2)+(La)). As such, typically, the predetermined length of anchorage or toe weld length Lw is greater than the length La of the joist aperture 44. In some embodiments, the predetermined length of anchorage Lw or toe weld length Lw is determined to be greater than or equal to the length of the aperture La and lesser than or equal to the length of the angle portion/joist seat Lj.

Accordingly, in some embodiments, the predetermined length of anchorage "Lw" ("predetermined length of weld" or "toe weld length") of the toe 44 which is configured to provide the same (or greater) anchorage, uplift capacity and rollover capacity for slotted type angle portions, as that would be obtained for unslotted type angle portions (e.g., no aperture within the angle portion, or for an angle portion whose slots are welded or otherwise operatively coupled to the support member), can be determined to be at least about a factor of the length of the aperture La. Specifically, the predetermined length of anchorage Lw can be determined to be about 2, 2.1, 2.2, 2.3, 2.4, 2.5, 2.6, 2.7, 2.8, 2.9, 3, 3.1, 3.2, 3.3, 3.4, or 3.5 times the length of the aperture La or in the range of 2 to 3.5, 2.2 to 3.5, 2 to 4, 1.8 to 4 times the length of the aperture La. That is, the predetermined length of anchorage Lw and the length of the aperture La, $$\frac{Lw}{La},$$

can be can be determined to be about any of the above values, or range within, outside, or overlap any of the above values. In some instances, the predetermined length of anchorage Lw can be determined to be about 2-3.5 times the length of the aperture La, i.e., 2(La)≤Lw≤3.5 (La). In some instances, the predetermined length of anchorage Lw can be determined to be about 2.8 times the length of the aperture La, i.e., Lw≥2.8(La). In some instances, the predetermined length of anchorage Lw can be determined to be about at least twice the length of the aperture La, i.e., Lw≥2 (La). In some embodiments, the predetermined length of anchorage Lw can be determined to range between (i) around about at least twice the length of the aperture La and (ii) around about the length Lj of the angle portion 22 of the joist seat 20, i.e., 2(La)≤Lw≤Lj.

Accordingly, the predetermined length of anchorage "Lw" ("predetermined length of weld" or "toe weld length") of the toe 44 is configured such that it provides the same (or greater) anchorage, uplift capacity and rollover capacity for slotted type angle portions, as that would be obtained for unslotted type angle portions (e.g., no aperture within the angle portion, or for an angle portion whose slots are welded or otherwise operatively coupled to the support member), while allowing ease of and access for welding, and providing reduced time, costs and material requirements for the assembly.

Hence, for a slotted type angle portion having an aperture 44 which is not welded or otherwise operatively coupled or fastened, the ultimate uplift capacity P can be determined using the relation above with respect to an increased yield line length Ly for the slotted type angle portion and with respect to the larger moment arm a2 described above, as follows:

$$P_{slotted} = 2\frac{(M)(Ly)_{slotted}}{(a2)}$$

In some embodiments, the length of anchorage Lw or toe weld length Lw is structured to provide an ultimate uplift capacity of about 3.54, 4.12, 5.73, 6, 7.7, 9.54, 10.3, 11.6, 15 kip (kilo pound force) in the range of 2.7-11.6, 9.54-11.6, 6-15, 9-15, 8-20, 7-12 kip (kilo pound force), or outside, or in-between, or overlapping these ranges, or any number within these ranges.

Figure 7:
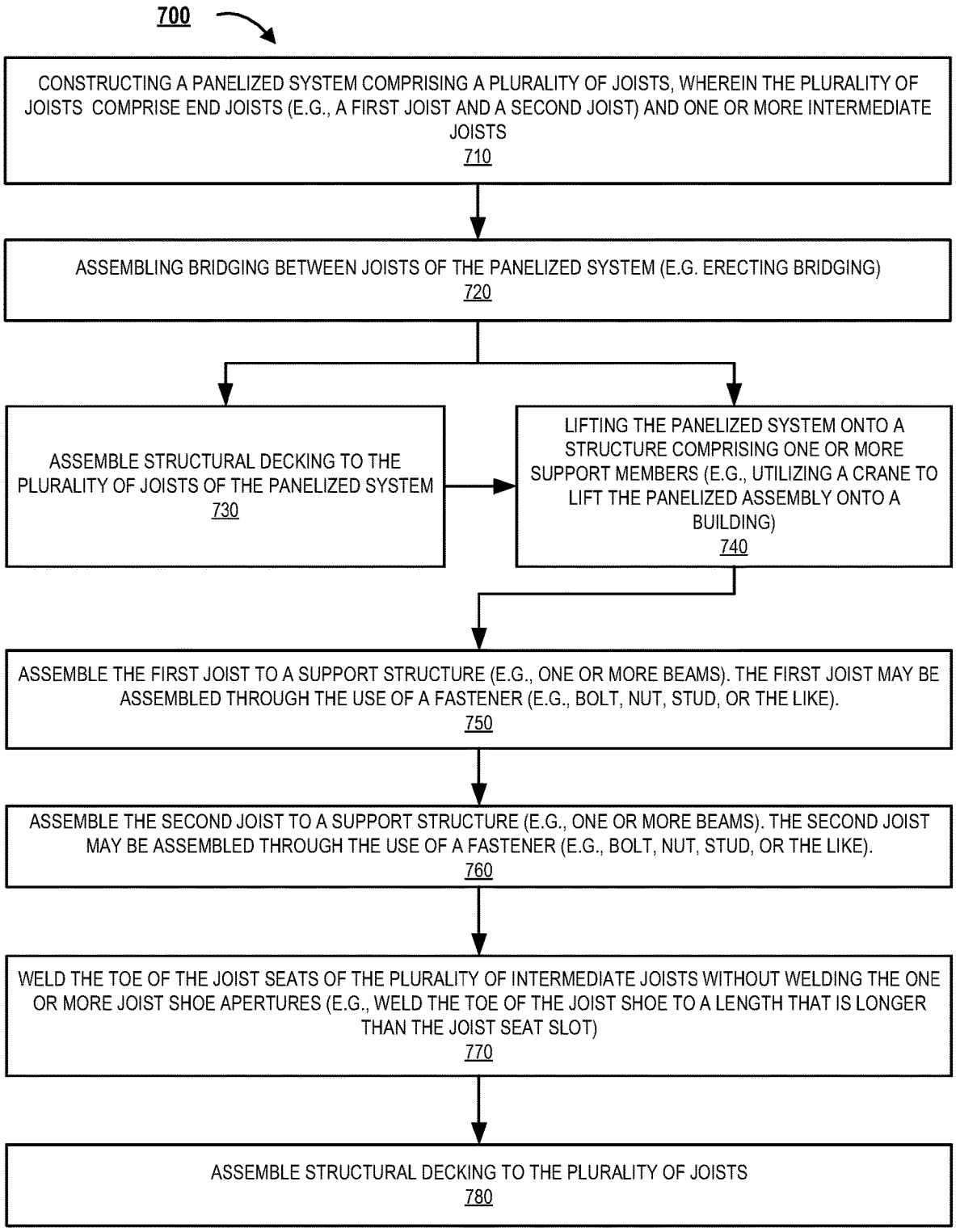
FIG. 7 illustrates a process flow for a method of forming a panelized system and/or a structural decking system, in accordance with some embodiments of the invention.

FIG. 7 illustrates a high level process flow 700 for a method of forming one or more panelized systems 101 and/or a structural decking system 100 form the one or more panelized systems 101. As discussed, the structural decking system 100 typically comprises a structure having one or more support members 10 and one or more panelized system 101 comprising a plurality of joists 16 (illustrated in FIG. 1A). In some embodiments, the one or more support members of the structure may comprise beam type (I-beam) support members (illustrated by FIG. 1B). In some embodiments, the panelized system comprises a plurality of joists 16 (illustrated by FIG. 1A), a plurality of joist seats 20 (illustrated by FIG. 1A-FIG. 6), one or more structural decking panels 14 (illustrated by FIGS. 1A-1B), and/or bridging between the joists (not illustrated). Typically, in general, the method involves forming a structural decking system 100 by constructing the one or more panelized systems 101 and assembling the one or more panelized systems 101 with one or more of the support members of the structure. In some embodiments, at least some of the plurality of joists 16 are assembled using one or more jigs to form the panelized system 101. Here, at least some of the plurality of joists 16 are typically panelized in a jig, such that the joists are positioned and situated in locations that would correspond to support members of a structure when the panelized system is lifted onto the structure. Typically, each of the joists are associated with a joist seat 20 comprising angle portions (22, 24), at least one toe 42 and at least one aperture 44, as described previously.

As indicated by block 710, the method involves constructing a panelized system comprising a plurality of joists 16. The plurality of joists 16 comprise end joists (e.g., a first joist, a second joist) and one or more intermediate joists.

Specifically, the first joist may be an end-type joist having one or more end joist seats 30 and may be configured to be assembled at a first end of the one or more support members 10 (e.g., when the panelized system having the joists 16 is lifted onto the structure having the support members). The second joist may be an end-type joist having one or more end joist seats 30 and may be assembled at a second end (e.g., an end opposite the first end) of the one or more support members 10. The one or more intermediate joists may be a third, fourth, fifth, six, seventh, and/or the like intermediate joists having one or more intermediate joist seats 40 and may be configured to be assembled between the first end and the second end of the one or more support members 10 between the end joists.

In some embodiments, the plurality of joists are typically assembled (i.e., positioned, situated, or at least partially coupled) within a jig for forming the panelized system 101. In some embodiments, typically, the first joist is assembled (i.e., positioned, situated, or at least partially coupled) within the jig. In some embodiments, the second joist is assembled (i.e., positioned, situated, or at least partially coupled) within the jig, e.g., along with the first joist. In some embodiments, the one or more intermediate joists may be assembled (i.e., positioned, situated, or at least partially coupled) by positioning or situating each of the intermediate joists within the jig, e.g., between the first joist and the second joist, within the jig. The jig may allow for proper positioning of the joists 16 as they will be installed on the structure.

In accordance with embodiments of the present invention each of the end joists and intermediate joists have joist seats with one or more joist apertures. In this way, during manufacturing different joists with different joist seats do not have to be produced and/or inventoried. Moreover, having the same type of joists 16 with the same joist seats 20 allows for the use of any type of joist 16 in any location when assembling each of the joists 16 to the panelized system and/or structural decking system. As such, the costs associated with manufacturing and assembling the panelized systems is reduced because different joists with different joist seats do not have to be produced and/or assembled.

It should be understood that in some embodiments different types of joists may be required in different locations within the structure, such as joists that are assembled over columns in the building. For example, column joists may have different structural requirements when compared to joists that are not located at columns. These joists that may be required at column locations may be either end joists or intermediate joists depending on where each panelized system 101 is being installed in the structure. As such, some joists may be different than other joists, but all of the joists may still have one or more apertures in the joist shoe. Moreover, it should be understood that the present invention reduces the number of joist markings required. That is, the joist markings (e.g., markings made by the manufacturer of the joists to identify different joists for assembly) may be minimized to two types of joists (e.g., when different column joists are required, or the like) for the panelized systems. Alternatively, in some embodiments all of the joists may be the same for the panelized systems, and thus, no joist markings may be required. By utilizing joist shoes with one or more joist apertures on all of the joists of the panelized systems, the number of joists (and joist markings) may be minimized regardless of whether or not different joists are required at column locations in the structure.

In some embodiments, the method 700 involves assembling bridging between the joists of the panelized assembly (e.g., erecting bridging), as indicated by block 720. In some embodiments, bridging is assembled between two or more of the joists comprising the first joist, the second joist and the one or more intermediate joists. The bridging may be any type of member, such as bars (circular, square, or any other type of shape), one or more angles (e.g., L-shaped, u-shaped, c-shaped, or the like), or any other type of member that is used to operatively coupled two different joists together (e.g., two adjacent joists, or the like).

Next, as indicated by block 730, the structural decking panels and/or other components may then be operatively coupled (e.g., assembled) with the plurality of joists of the panelized system and/or each other using a suitable joining method (e.g., using a connector 15 illustrated in FIG. 1D, using fasteners, welding, shearing a sidelap, or the like). Alternatively, or in addition, to assembling the structural decking panels before lifting the panelized system 101, it should be understood that some of the structural decking panels may be installed after lifting the panelized system into place, either before, after or during welding the toes 42 of the one or more intermediate joists 16*b* (as is indicated by block 780 later on).

In this manner, the panelized system 101 may be constructed in accordance with some embodiments of the invention. The panelized system may be associated with a roof portion, a floor portion, or a wall portion, or combination thereof and/or other components of a structure or building. As discussed, forming the panelized system typically involves completing the panelized system 101 as indicated by steps 710-720 and/or step 730 (and/or additional steps, such as attaching other components). As discussed, in some embodiments, at least some of the plurality of joists (one or more of the first joist, second joist and/or the one or more intermediate joists), the bridging and/or the structural decking panels are assembled within a jig (or one or more jigs) for forming the panelized system 101.

Next, the method involves hoisting or lifting the panelized system 101 onto the structure or building (e.g., utilizing a crane to lift the panelized assembly onto a structure, such as a building), as indicated by block 740. In some embodiments, a spreader bar is employed to attach the joists to the crane, which allows lifting of the panelized system from two or more of the joists (e.g., adjacent the center of the joists) in order to distribute lifting loads.

Subsequently, after lifting the panelized assembly onto the structure, in some embodiments, the corners of the panelized assembly may be bolted or otherwise fastened for safety. Here, the first joist and/or the second joist may be bolted down to a corresponding support member of the structure, at, at least one aperture of at least one corresponding joist seat, thereby allowing the first joist and/or the second joist to serve as an edge of the installed panelized system.

For example, after lifting the panelized assembly onto the structure, the first joist may be assembled to a corresponding proximate support member (e.g., one or more beams or support member 12 of FIG. 1B) of the structure, as indicated by block 750. In some embodiments, the first joist may be assembled to the support member through the use of a fastener (e.g., bolt, nut, stud, or the like) at an aperture of a joist seat of the first joist. It is contemplated that in other embodiments, the first joist may be assembled through welding (e.g., spot welding, welding the toe, welding the one or more apertures) or other joining processes.

Similarly, the method involves assembling or operatively coupling at least the second joist to a corresponding proximate support member (e.g., one or more beams or support member 12 of FIG. 1B), as indicated by block 760, in accordance with some embodiments of the invention. In some embodiments, the second joist may be assembled through the use of a fastener (e.g., bolt, nut, stud, or the like) at an aperture of a joist seat of the second joist. It is contemplated that in other embodiments, the second joist may be assembled through welding (e.g., spot welding, welding the toe, welding the one or more apertures) or other joining processes.

Operatively coupling the one or more apertures of the end joist seats of the end joists to the support members provides structural support to allow for installers to walk on the installed panelized system during additional assembly (e.g., assembly of the intermediate joist shoes, additional decking assembly, and/or additional support members). Moreover, operatively coupling the one or more apertures of the end joist seats also provides uplift capacity, shear capacity, and/or other loading capacity with respect to environmental loading (e.g., wind, etc.) during the additional assembly processes.

Next, the method involves welding at least a toe of an intermediate joist seat 30 of at least one intermediate joist (i.e., one or more intermediate joists) to the one or more support members (e.g., to support member 12) of the structure, as indicated by block 770. Typically, as discussed with respect to FIGS. 2-6, the at least one toe 44 is welded along predetermined length of anchorage or toe weld length "Lw" which is configured to provide the same (or greater) anchorage, uplift capacity and rollover capacity for the slotted type joist seat 30, as that would be obtained for unslotted type joist seats or joist seats whose apertures are welded or otherwise operatively coupled to the support member. As such, the aperture weld (or other operative couplings such as fasteners) between an intermediate joist 30 the one or more support members are omitted. As previously discussed herein, it may be difficult to access the one or more joist apertures (e.g., slotted apertures) in the joist seats when the panelized system 101 is installed, particularly in light of the assembled structural decking panels at least partially obscuring or impeding access to joist apertures (e.g., as illustrated at Region B of FIG. 1B). Moreover, it may be difficult to weld inside the joist apertures (e.g., slotted apertures) when installed into a structure (or otherwise utilize tooling to make other connections at the joist apertures). As such, the present invention allows for formation of a weld only at the toe 42 of the intermediate joist seat 40, which will meet or exceed the uplift capacity of the decking system, while making it much easier to install the decking (e.g., easier to make a single toe weld on the intermediate joist seat, compared to welding within the one or more apertures 44). The length of the toe weld may be determined and/or formed as previously described herein.

Next, as indicated by block 780, the structural decking panels 14 and other components may then be assembled with the plurality of joists using a suitable joining method (e.g., using fasteners, welding, shearing a sidelap, or the like). It should be understood that the decking panels may be installed before, during, and/or after welding the toes 42 of the one or more intermediate joists 16*b*.

While the invention is described herein with respect to pre-forming panelized systems before lifting the panelized systems into place in a building structure, it should be understood that the same concepts described herein (e.g., utilizing the same joist seats) may also be utilized when installing the individual components into a structure on a component by component basis (e.g., installing each joist into place within the structure).

Figure 8:
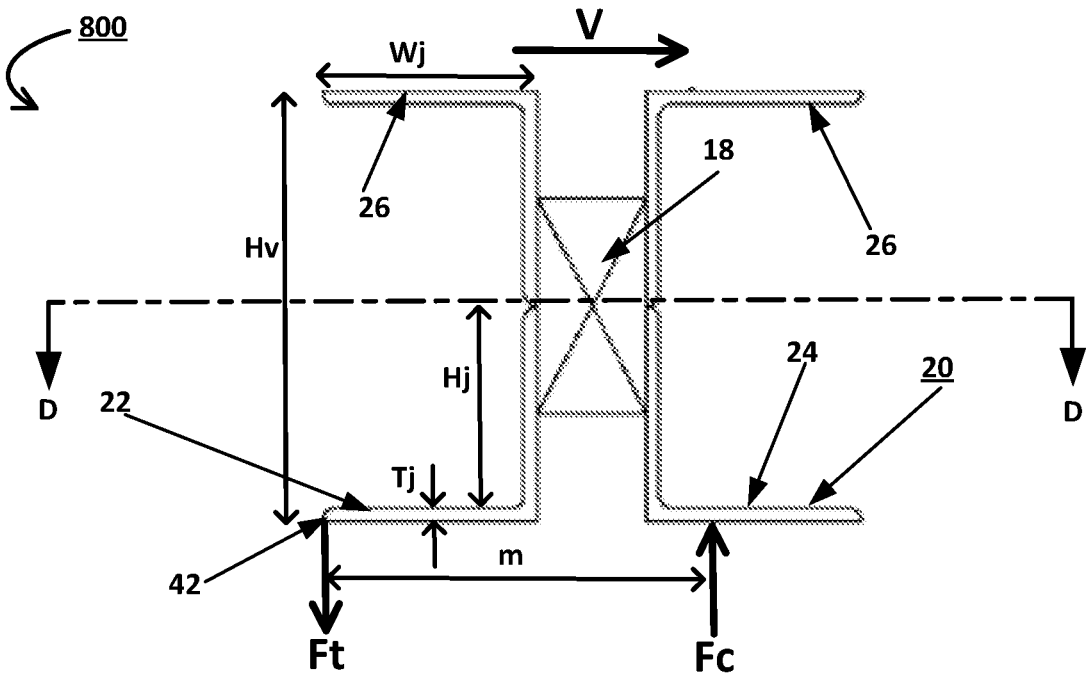
FIG. 8 illustrates an end view of a joist seat, in accordance with some embodiments of the invention.

FIG. 8 illustrates a schematic sectional view 800 of a joist seat 20, in accordance with some embodiments of the invention. The sectional view 800 also depicts a schematic free body diagram representing loading of the joist seat 20 in accordance with some embodiments of the invention. As discussed previously, the joist seat 20, in accordance with these embodiments, may comprise a pair of angle portions (22, 24), each having a toe 42. The angle portions 22 and 24 are operatively coupled to each other via the component 18. The angle portions (22, 24) comprise a substantially "L" shaped cross section formed by first portions (22*a*, 24*a*) and second portions (22*b*, 24*b*), respectively, as illustrated by FIG. 3. As such, the angle portions 22 and 24 are operatively coupled to each other and to upper chords 26 via the component 18. However, as discussed previously, in other embodiments not illustrated herein, the angle portions (22, 24) may be integral with the upper chords 26 to form a substantially "C" shaped cross section. As illustrated in FIG. 8, each of the angle portions 22 and 24 of the joist seat 20 may comprise a width "Wj", a height "Hj", a length "Lj" (illustrated in FIG. 9) and a thickness of "Tj". The height of the angle portions (22, 24) together with that of the upper chords 26 forms a height Hv.

Typically, load "V" of FIG. 8 represents the ultimate rollover force (or rollover capacity) required for a weld 160 at the toe 42 to yield under the loading V. The force components "Ft" and "Fc" are equal and opposite forces that result from the loading V. The force Ft is a tension component and the force Fc is a compression component forming a couple, which are separated by a couple length "m". The ultimate rollover force V will be described below. Typically, the value of tension and compression components is directly proportional to the ultimate rollover force V and a ratio of the height Hv and couple length m:

$$Ft = V\frac{(Hv)}{(m)} = -Fc$$

Figure 9:
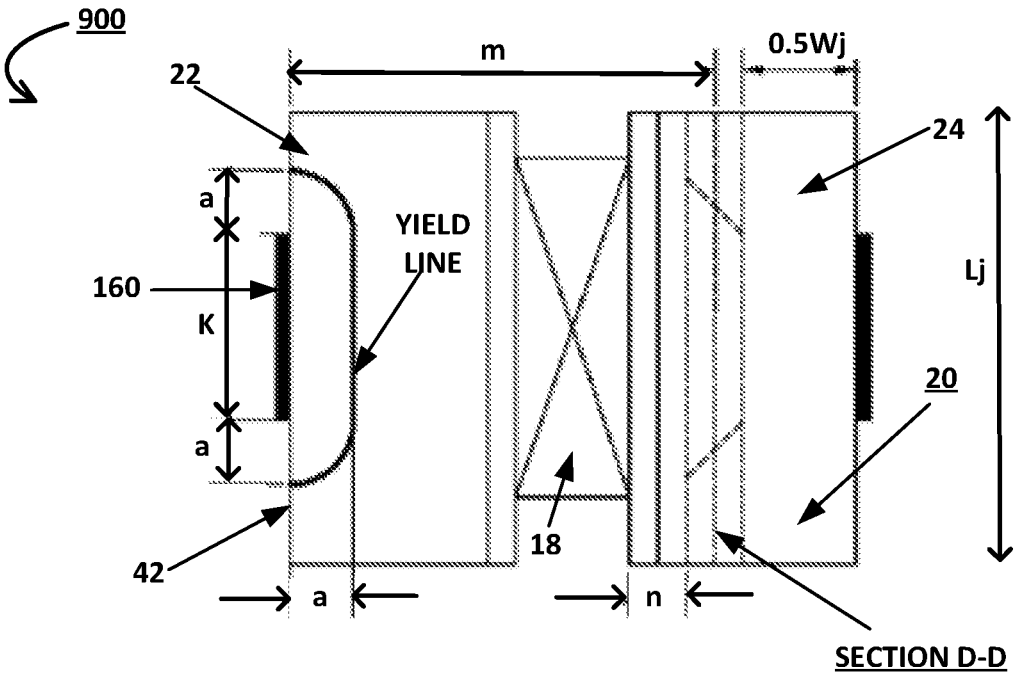
FIG. 9 illustrate a top cross-section view of the joist seat of FIG. 8, in accordance with some embodiments of the invention.

FIG. 9 illustrates a schematic top sectional view 900 of the joist seat 20 illustrated in FIG. 8 at the section D-D, in accordance with some embodiments of the invention. Specifically FIG. 9 indicates a top view of the angle portion 22 being operatively coupled with a corresponding support member by the weld 160 along the length K of the toe 42. As discussed, the length "a" indicates the length of the moment arm from the toe 42 to the yield line. FIG. 9 also indicates the yield line along which the angle portion 22 of the joist seat 20 would yield under the load. The length "n" indicates a distance between an inside edge of the angle portion 24 to an edge of a fillet of the angle portion 24.

Referring to FIGS. 8-9, as discussed previously with respect to FIGS. 3-5, the ultimate uplift load P can be determined as:

$$P = 2\frac{(M)(Ly)}{(a)}$$

Here, it is noted that the plastic moment capacity per unit length M can be determined to be equal to a product of yield stress "Y" of a material from which the angle portion 22 is constructed (e.g., steel) and a plastic section modulus of unit length "Z" of the angle portion 22, i.e., M=(Y)(Z). Moreover, the plastic section modulus of unit length Z is typically equal to a fourth of a square of the thickness Tj of the angle portion 22, i.e., $$Z = \frac{(Tj)^2}{4}.$$

Moreover, it is noted that the length Ly of the yield line can be determined to be the lesser of (i) a sum of the length of weld K and perimeter of the curvature with radius a, i.e., (K+πa) and (ii) the length Lj of the angle portion 22 of the joist shoe/seat 20. Moreover, the length a can be determined as a function of the thickness Tj such that (a)=2.3(Tj).

The distance between the tension and compression force components "m" can be determined by setting a moment resisted by the yield lines one the tension and compression sides in equilibrium. Hence, the length m can be determined to be about:

$$m=1.25(W)+g+0.5(n)$$

Here, length "n" indicates a distance between an inside edge of the angle portion 24 to an edge of a fillet of the angle portion 24 and the length "g" is a distance between the angle portions 22 and 24, i.e., the width of component 18. Consequently, based equilibrium of forces, the ultimate roll over force V can be determined to be:

$$V = \frac{(M)(Ly)}{(a)} \cdot \frac{(m)}{(Hv)}$$

In the second scenario discussed earlier, involving a slotted type angle portion having an aperture 44 which is not welded or otherwise operatively coupled or fastened, the uplift rollover capacity V can be determined using the relation above with respect to an increased yield line length Ly for the slotted type angle portion and with respect to the larger moment arm a2 described above, as follows:

$$V_{slotted} = \frac{(M)(Ly)_{slotted}}{(a2)} \cdot \frac{(m)}{(Hv)}$$

Hence, based on the length of the moment arm a2 for a slotted type angle portion and the predetermined length of anchorage "Lw" ("predetermined length of weld" or "toe weld length") of the toe 44 which is configured to provide the same (or greater) anchorage with respect to unslotted types, as discussed above, the uplift rollover capacity V for slotted type angle portions is the same as or greater than that would be obtained for unslotted type angle portions (e.g., no aperture within the angle portion, or for an angle portion whose slots are welded or otherwise operatively coupled to the support member).

In some embodiments, the uplift rollover capacity V of the weld 160 may be about 4.18, 5.24, 6.20, 7.11, 7.35, 8 kip (kilo pound force), in the range of 4.18-6.70, 4.39-7.35, 0.69-10, 1-6, 5.02-12, 4.01-18, 7.0-14.5 kip (kilo pound force), or outside, or in-between, or overlapping these ranges, or any number within these ranges. Although determined above using "yield line model", in other embodiments, the uplift rollover capacity V is determined using other models such as an elastic model and an ultimate strength model.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A panelized system for a structure, wherein the system comprises:

a plurality of joists operatively coupled to each other, each of the plurality of joists comprising a joist seat having at least one angle, the angle comprising a toe and a single slotted joist aperture in the angle;

wherein the joist seat of at least one of the plurality of joists is structured to be operatively coupled to a support member of the structure using a toe weld between the toe and the support member, wherein no connection is made between the slotted joist aperture and the support member, and wherein the toe weld is continuous and has a toe weld length that is greater than an aperture length of the slotted joist aperture.

2. The system of claim 1, wherein the plurality of joists comprise:

two end joists; and one or more intermediate joists;

wherein the slotted joist aperture of each of the two end joists are configured for operative coupling to the support member through the use of an aperture connection; and wherein no connection is made between the slotted joist aperture of the one or more intermediate joists.

3. The system of claim 1, wherein the toe weld is formed after the panelized system is hoisted onto the structure.

4. The system of claim 1, wherein the toe weld length is configured to provide at least a predetermined ultimate uplift strength to the joist seat, wherein the predetermined ultimate uplift strength is an ultimate uplift strength obtained if the aperture connection between the slotted joist aperture and the support member is made.

5. The system of claim 4, wherein the toe weld length is equal to at least about two times the aperture length of the slotted joist aperture.

6. The system of claim 1, wherein the plurality of joists are operatively coupled to each other through bridging.

7. The system of claim 1, further comprising:

structural decking operatively coupled to the plurality of joists, wherein the structural decking may be operatively coupled to the plurality of joists before or after forming the toe weld.

8. A building structure, wherein the building structure comprises:

two or more support members; and a plurality of joists, each of the plurality of joists comprising a joist seat having at least one angle, the angle comprising a toe and a single joist aperture;

wherein a first joist of the plurality of joists has a first joist seat that is operatively coupled to a support member of the two or more support members through a first aperture connection between a first joist seat aperture and the support member;

wherein a second joist of the plurality of joists has a second joist seat that is operatively coupled to the support member through a second aperture connection between a second joist seat aperture and the support member; and wherein one or more intermediate joists of the plurality of joists each have an intermediate joist seat that is operatively coupled to the support member using a toe weld between the toe of of the intermediate joist seat and the support member, wherein no connection is made between an intermediate joist seat aperture and the support member, and wherein the toe weld is continuous and has a toe weld length that is greater than an aperture length of the intermediate joist seat aperture.

9. The building structure of claim 8, wherein the joist aperture is a slotted joist aperture, and wherein the toe weld length of the toe weld is greater than the aperture length of the slotted joist aperture.

10. The building structure of claim 9, wherein the toe weld length is configured to provide at least a predetermined ultimate uplift strength to the intermediate joist seat of the one or more intermediate joists, wherein the predetermined ultimate uplift strength is the ultimate uplift strength obtained if an intermediate aperture connection between the intermediate joist seat aperture and the support member is made.

11. The building structure of claim 10, wherein the toe weld length is equal to at least about two times the aperture length of the slotted joist aperture.

12. A method for forming a structural decking system using a panelized system, the method comprising:

constructing the panelized system comprising a plurality of joists, wherein each of the plurality of joists comprise a joist seat having at least one angle, the angle comprising a toe and a single joist aperture in the angle, wherein the plurality of joists comprises a first end joist, a second end joist and one or more intermediate joists;

hoisting the panelized system onto a structure comprising one or more support members;

assembling the first end joist of the plurality of joists to a support member of the one or more support members using a first end joist seat, wherein assembling the first end joist comprises making a first aperture connection between a first joist seat aperture and the support member;

assembling the second end joist of the plurality of joists to a support member of the one or more support members using a second end joist seat, wherein assembling the second end joist comprises making a second aperture connection between a second joist seat aperture and the support member; and assembling the one or more intermediate joists of the plurality of joists to the support member of the one or more support members between the first end joist and the second end joist;

wherein assembling the one or more intermediate joists comprises forming a toe weld between the toe of an intermediate joist of the one or more intermediate joists to the support member of the one or more support members, and wherein no connection is made between an intermediate joist seat aperture and the support member of the one or more support members, and wherein the toe weld is continuous and has a toe weld length that is greater than an aperture length of the intermediate joist seat aperture.

13. The method of claim 12, wherein the intermediate joist seat aperture is an intermediate slotted joist seat aperture, and wherein a toe weld length of the toe weld is greater than an intermediate aperture length of the intermediate slotted joist seat aperture, and wherein the told weld is formed after the panelized system is hoisted onto the structure.

14. The method of claim 12, wherein the toe weld length is configured to provide at least a predetermined ultimate uplift strength to the intermediate joist seat, wherein the predetermined ultimate uplift strength is an ultimate uplift strength obtained if the an intermediate aperture connection between the intermediate joist seat aperture and the support member is made.

15. The method of claim 14, wherein the toe weld length is equal to at least about two times an intermediate aperture length of the intermediate joist seat aperture.

16. The method of claim 12, wherein the method further comprises:

assembling bridging between two or more of the plurality of joists.

17. The method of claim 12, wherein the method further comprises:

assembling one or more structural decking panels to one or more of the plurality of joists.

18. A method for forming a structural decking system using a panelized system, the method comprising:

constructing the panelized system comprising a plurality of joists, wherein each of the plurality of joists comprise a joist seat having at least one angle, the angle comprising a toe and a single joist aperture in the angle;

hoisting the panelized system onto a structure comprising one or more support members;

assembling at least a first joist from the plurality of joists to the one or more support members using a first joist seat, wherein assembling the first joist comprises making an aperture connection between a first joist seat aperture of the first joist seat and a support member of the one or more support members; and assembling at least a second joist from the plurality of joists to the one or more support members using a second joist seat, wherein assembling the second joist comprises forming a toe weld between the toe of the second joist seat to the support member of the one or more support members, wherein no connection is made between a second joist seat aperture and the support member of the one or more support members, and wherein the toe weld is continuous and has a toe weld length that is greater than an aperture length of the second joist seat aperture.

* * * * *